US010174917B1

(12) United States Patent
Wronski et al.

(10) Patent No.: US 10,174,917 B1
(45) Date of Patent: Jan. 8, 2019

(54) RETENTION DEVICES FOR RECESSED LUMINAIRES

(71) Applicant: Cooper Technologies Company, Houston, TX (US)

(72) Inventors: Grzegorz Wronski, Peachtree City, GA (US); Kevin Roy Harpenau, Atlanta, GA (US); Russell Bryant Green, Douglasville, GA (US); Philip Dean Winters, Senoia, GA (US); Jyoti Kumar, Smyrna, GA (US); Oliver Ernst, Peachtree City, GA (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 15/661,930

(22) Filed: Jul. 27, 2017

Related U.S. Application Data

(60) Provisional application No. 62/367,507, filed on Jul. 27, 2016.

(51) Int. Cl.

| | |
|---|---|
| ***F21V 21/04*** | (2006.01) |
| ***F21V 17/16*** | (2006.01) |
| ***F21S 8/02*** | (2006.01) |
| ***F21V 21/26*** | (2006.01) |

(52) U.S. Cl.
CPC ..... *F21V 21/04* (2013.01); *F21S 8/026* (2013.01); *F21V 17/16* (2013.01); *F21V 21/26* (2013.01)

(58) Field of Classification Search
USPC ..... 362/362–375
See application file for complete search history.

(56) References Cited

U.S. PATENT DOCUMENTS

2015/0300622 A1* 10/2015 Boomgaarden ..... F21S 8/026 362/294

* cited by examiner

*Primary Examiner* — Matthew Mikels
(74) *Attorney, Agent, or Firm* — King & Spalding LLP

(57) ABSTRACT

A luminaire includes a finishing section. The finishing section has a finishing cone that defines an internal cavity. The finishing section further includes a light source that is disposed within the internal cavity of the finishing cone. Additionally, the luminaire includes one or more retention devices that are coupled to the finishing cone. The one or more retention devices are configured to mount the finishing cone within a recessed can having one or more retention device receivers. The one or more retention devices include wire forms such as, but not limited to, spring wire forms and coiled wire forms. Alternatively, the one or more retention devices include a friction retention device.

16 Claims, 28 Drawing Sheets

140
130
160
150
250
250
250
250
250
250
250
250
140

RETENTION DEVICES FOR RECESSED LUMINAIRES

RELATED APPLICATIONS

The present application claims priority under 35 U.S.C. § 119(e) to U.S. Provisional Patent Application No. 62/367,507, titled "Retention Devices For Recessed Luminaires," and filed on Jul. 27, 2016. The entire contents of the foregoing application are hereby incorporated herein by reference.

TECHNICAL FIELD

Embodiments of the present disclosure relate generally to light fixtures, and more particularly to retention devices for recessed luminaires.

BACKGROUND

Typically, recessed luminaires may include a recessed housing can disposed in a ceiling and a finishing section. The finishing section may include a finishing cone that houses a light source. The finishing section may be installed in a ceiling by retaining the finishing cone within the recessed housing can that is disposed in the ceiling. Accordingly, there is a need for various cost-effective, easy to use, and/or simple retention devices for retaining the finishing cone (along with the light source) of a finishing section within a recessed housing can.

SUMMARY

In one aspect, the present disclosure relates to a luminaire. The luminaire includes a finishing section. The finishing section includes a finishing cone that defines an internal cavity, a light source disposed within the internal cavity of the finishing cone, and one or more retention devices that are coupled to the finishing cone and configured to mount the finishing cone within a recessed can having one or more retention device receivers. Each of the one or more retention devices include a curved middle portion, a first leg that extends out from one end of the curved middle portion, a second leg that extends out from an opposite end of the curved middle portion in a direction substantially opposite to that of the first leg, and a hook shaped feature disposed at ends of each of the first leg and the second leg that are farthest away from each other.

In another aspect, the present disclosure relates to a luminaire. The luminaire includes a finishing section. The finishing section includes a finishing cone that defines an internal cavity, a light source disposed within the internal cavity of the finishing cone, and one or more retention devices that are coupled to the finishing cone and configured to mount the finishing cone within a recessed can having one or more retention device receivers. Each of the one or more retention devices includes a first leg. The first leg has a first hook shaped feature disposed at a first end of the first leg, and wherein a second opposite end of the first leg is bent such that it projects substantially perpendicular to the first leg. Further, each of the one or more retention devices includes a second leg that is separate from the first leg. The second leg has a second hook shaped feature disposed at a first end of the second leg, and wherein a second opposite end of the second leg is bent such that it projects substantially perpendicular to the second leg.

In yet another aspect, the present disclosure relates to a retention device. The retention device includes a curved top section that has a substantially C-shaped profile, a first leg extending from a first end of the curved top section, and a second leg extending from a second end of the curved top section. Each of the first leg and the second leg includes a first vertical portion extending from a respective end of the curved top section, a second bent portion extending from the first vertical portion at an obtuse angle to the first vertical portion, a third bent portion extending from the second bent portion at an acute angle to the second bent portion, and a hook shaped feature extending from third bent portion.

These and other aspects, objects, features, and embodiments, will be apparent from the following description and the appended claims.

BRIEF DESCRIPTION OF THE FIGURES

The foregoing and other features and aspects of the present disclosure are best understood with reference to the following description of certain example embodiments, when read in conjunction with the accompanying drawings, wherein.

Figure 1:
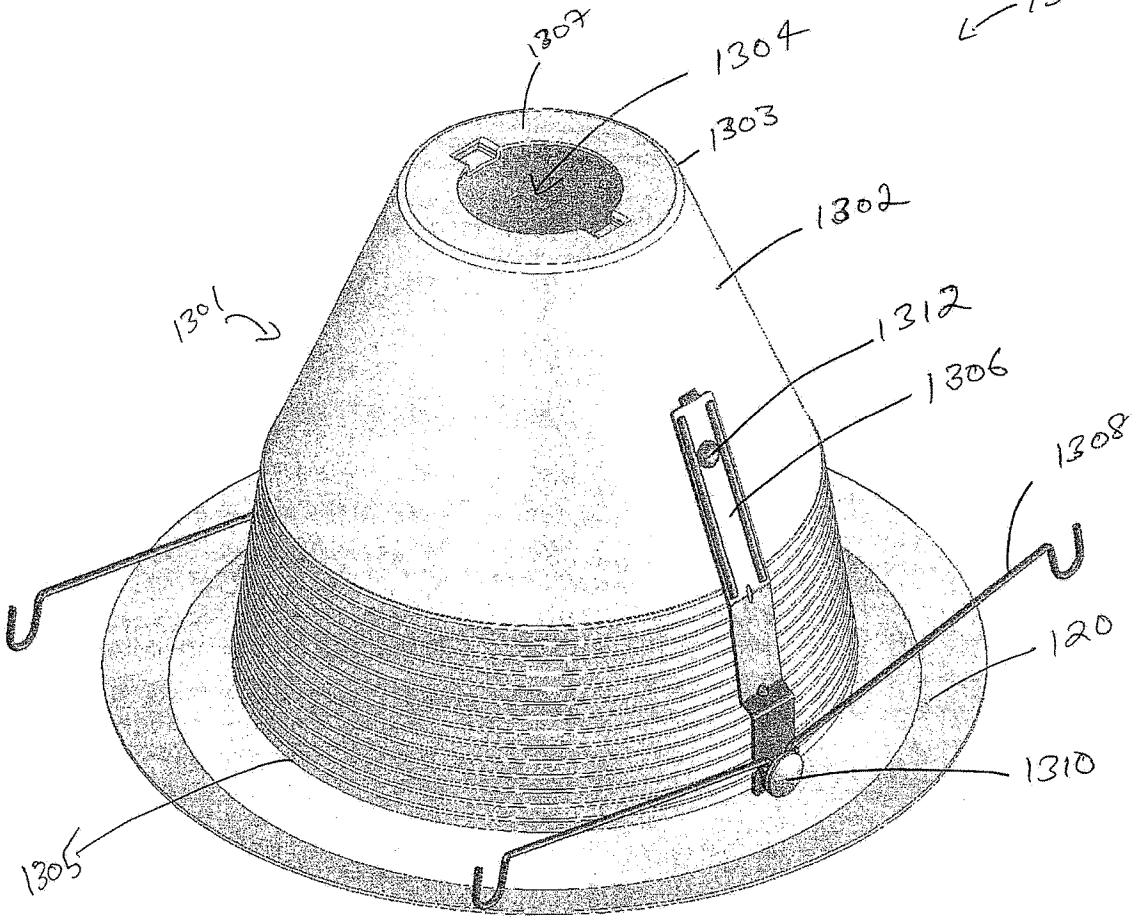
FIG. 1 illustrates a perspective view of an example finishing section with a first example retention device, in accordance with example embodiments of the present disclosure.

The drawings illustrate only example embodiments of the present disclosure and are therefore not to be considered limiting of its scope, as the present disclosure may admit to other equally effective embodiments. The elements and features shown in the drawings are not necessarily to scale, emphasis instead being placed upon clearly illustrating the principles of the example embodiments. Additionally, certain dimensions or positions may be exaggerated to help visually convey such principles.

DETAILED DESCRIPTION

The present disclosure describes a plurality of example retention devices having different shapes, sizes, and/or structures for retaining a finishing cone of a finishing section within a recessed housing can. In particular, the retention devices may be coupled to the finishing cone of the finishing section using coupling brackets. The coupling of the retention devices to the coupling brackets may include, but is not limited to, stiff coupling or hinged coupling that allows the retention devices to pivot or rotate about the respective coupling bracket to which it is coupled. Further, the coupling brackets may vary based on the specific shape, size, and/or structure of the retention device and the type of coupling between the retention devices and the coupling brackets.

The retention devices disclosed herein may include: (i) wire or flat spring forms (herein 'wire form retention devices' or 'wire forms') that retain the finishing section within the recessed housing can using spring characteristics or a spring action of the retention device, and (ii) friction retention devices that retain the finishing section within the recessed housing can using friction or interference fit.

The technologies of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "example embodiments" given herein are intended to be non-limiting and among others supported by representations of the present technology.

Figure 15:
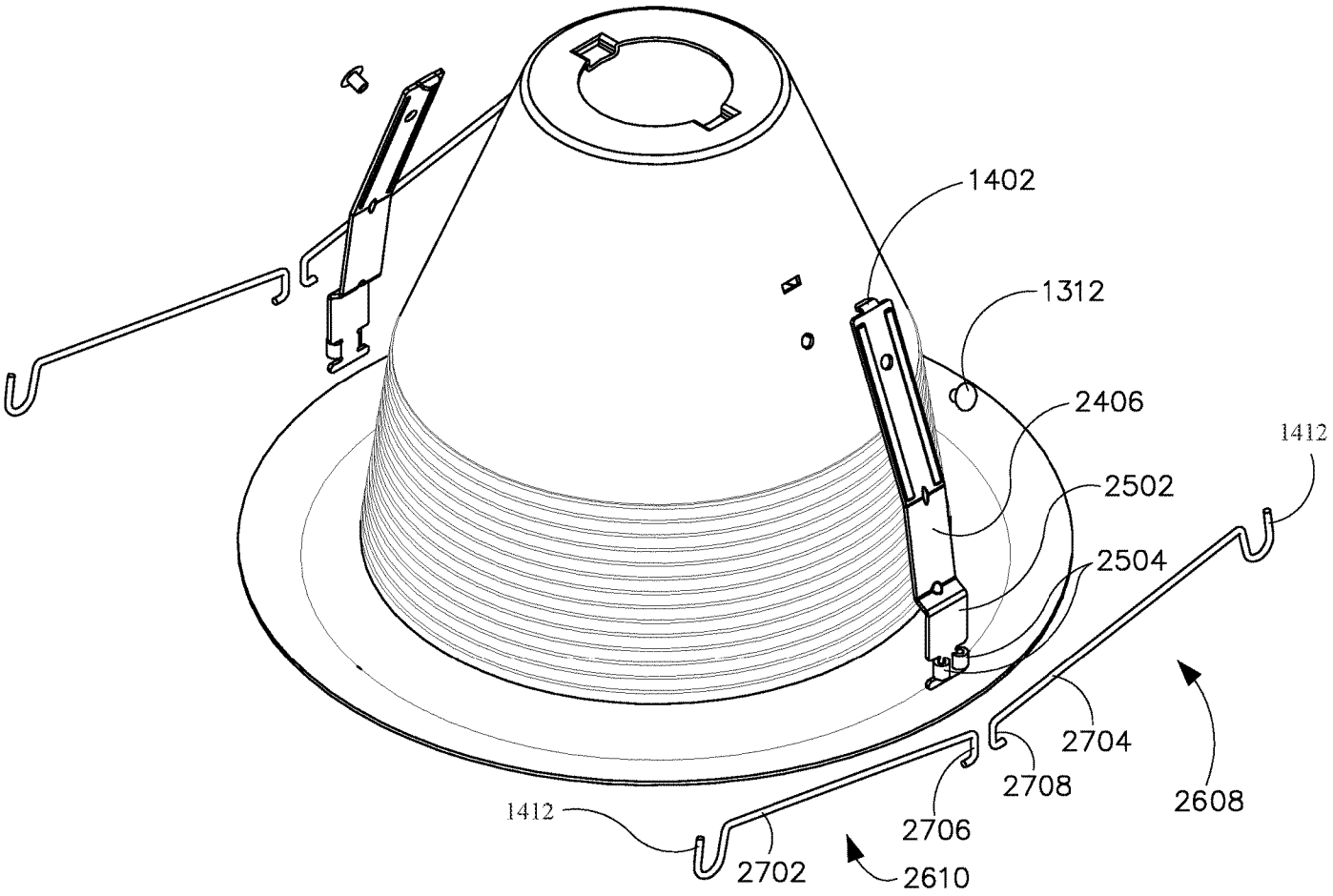
FIG. 15 illustrates an exploded view of the finishing section of FIG. 1 with the second example two-part retention device, in accordance with example embodiments of the present disclosure.
Figure 16:
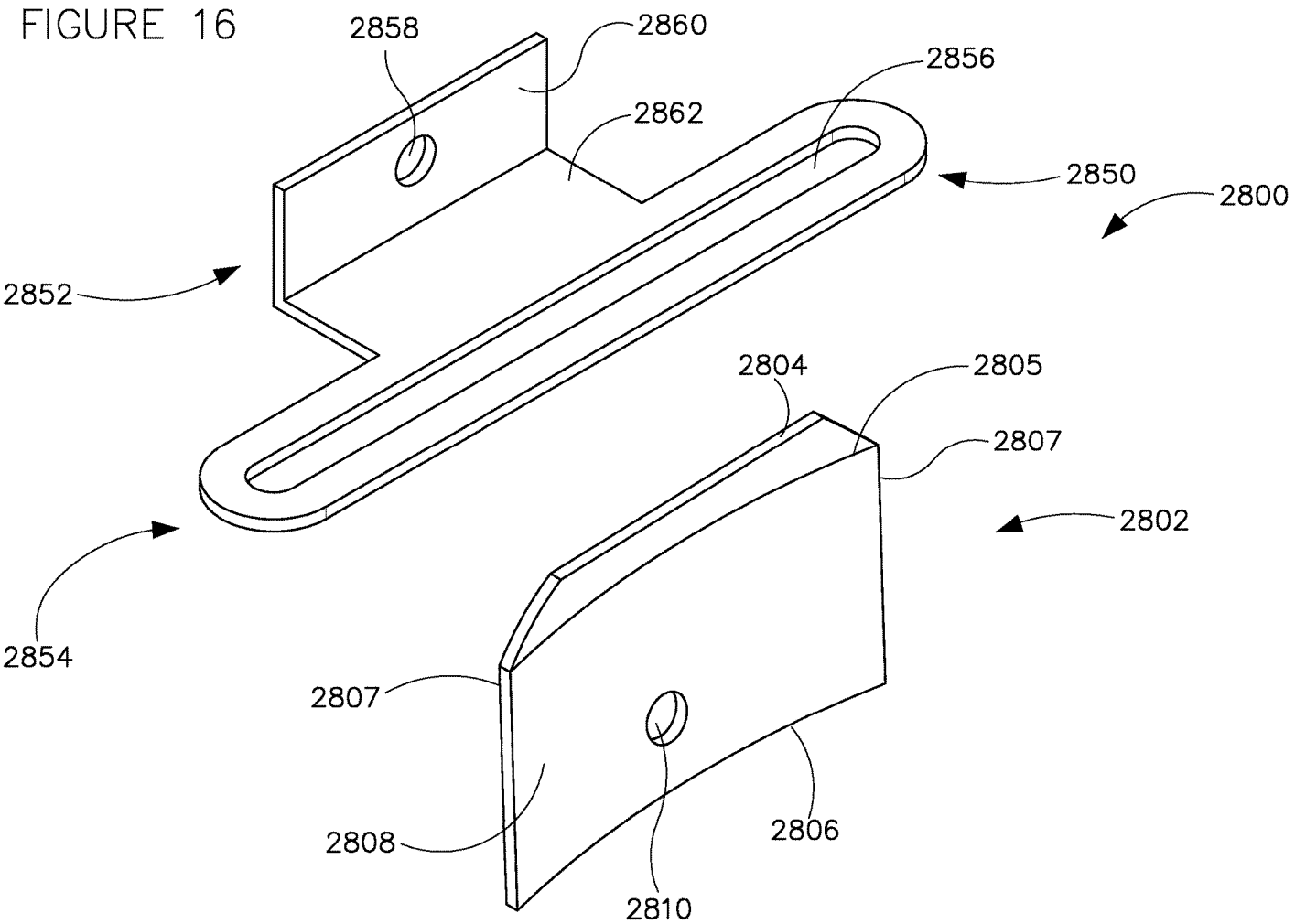
FIG. 16 illustrates a perspective view of a friction retention device of a finishing section and a friction retention device receiver of the recessed housing can, in accordance with example embodiments of the present disclosure.

Moving now to discuss the figures, FIGS. 1-15 and 17-28 will describe different example embodiments of wire form retention devices; and FIG. 16 will describe an example embodiment of a friction retention device.

Wire Form Retention Devices

As described above, the different wire form retention devices will be described in the following paragraphs. In particular, first, FIGS. 1-10 and 12-15 will be described in association with extension spring shaped wire forms, and FIG. 11 will be described in association with a coiled wire form embodiment. Then, FIGS. 17-28, will be described in association with a substantially diamond shaped wire form.

i. Spring Wire Forms

Spring wire forms are wire forms that have two legs that extend in substantially opposite directions and have a hook shaped structure at the end of each leg. Opposite ends of the two legs, i.e., ends opposite to the hook shaped structure, may either be joined or separate from each other and may be coupled to the finishing cone of the finishing section. To install a finishing section within a recessed housing can 410 using spring wire forms, the two legs of the spring wire forms may be pinched together or compressed and they are hooked on the wire form receivers 404 (shown in FIG. 20) within the recessed housing can 410 (shown in FIG. 20). Further, the expansion of the spring wire forms back to its default position may exert an upward force on the finishing cone, thereby, pulling the finishing section up into the recessed housing can 410 till a trim flange 120 of the finishing section engages the ceiling (or other mounting surface) or a bottom edge of the recessed housing can. Example spring wire forms will be described below in greater detail in association with FIGS. 1-10 and 12-15.

Figure 2:
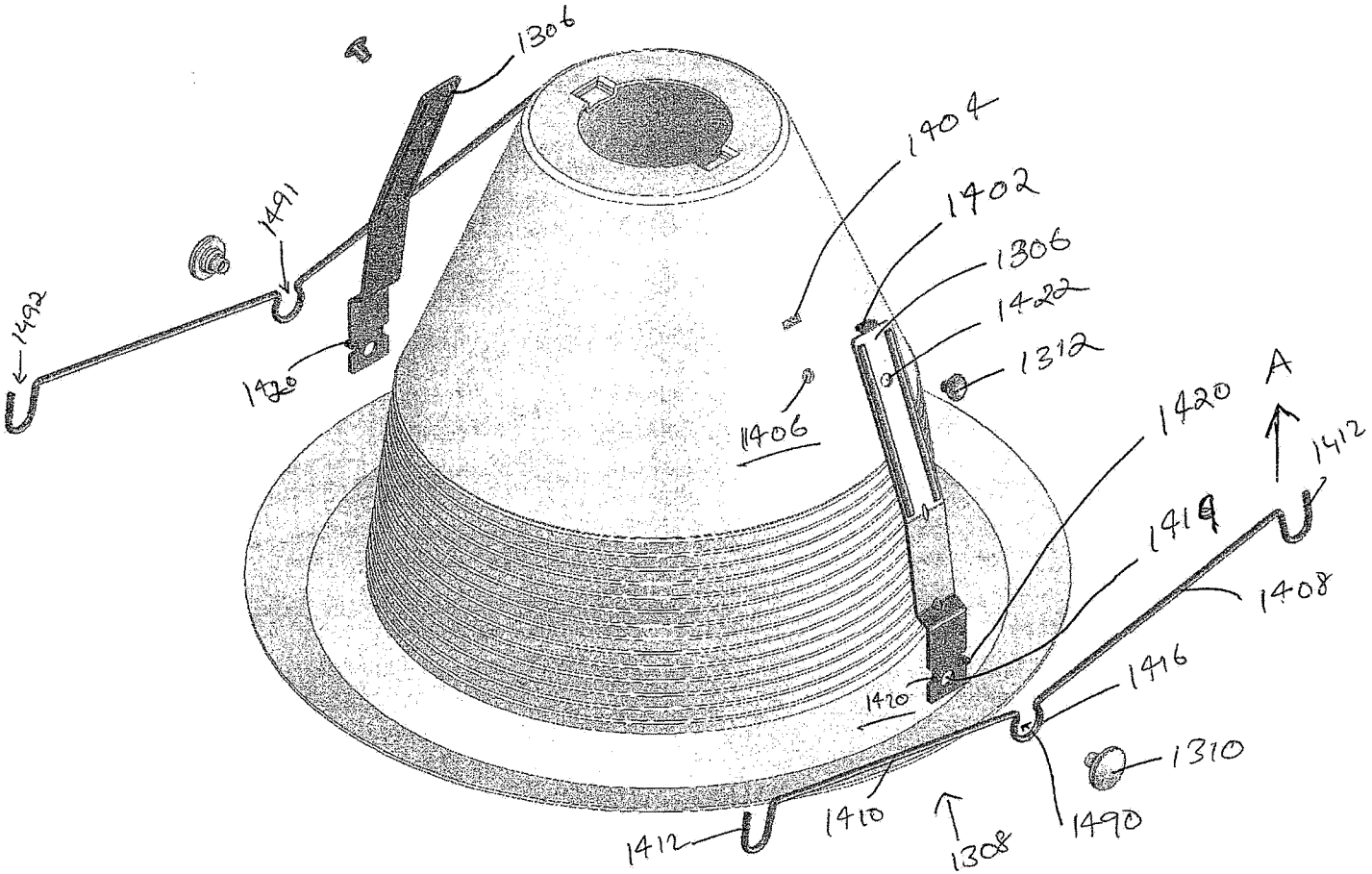
FIG. 2 illustrates an exploded view of the finishing section of FIG. 1 with the first example retention device, in accordance with example embodiments of the present disclosure.

Turning to FIGS. 1 and 2, FIG. 1 illustrates a perspective view of an example finishing section with a first example retention device, in accordance with example embodiments of the present disclosure; and FIG. 2 illustrates an exploded view of the finishing section of FIG. 1 with the first example retention device, in accordance with example embodiments of the present disclosure.

Referring to FIGS. 1 and 2, a finishing section 1300 includes a finishing cone 1301 that has a top annular edge 1303 that defines a perimeter of a top surface 1307, a bottom annular edge 1305, and a body 1302 that extends from the top annular edge 1303 to the bottom annular edge 1305. Further, the finishing cone 1301 may include a trim flange 120 that extends radially outward from the bottom annular edge 1305. The finishing cone 1301 may be configured to house a light source within an internal cavity 1304 defined by an inner surface of the finishing cone 1301.

Further, the finishing section 1300 may include a pair of mounting brackets 1306 that are coupled to the body 1302 of the finishing cone 1301 using locator tabs 1402 of the mounting bracket 1306 and fasteners 1312. As illustrated in FIG. 2, the locator tab 1402 of each mounting bracket 1306 may be disposed on a top end of the mounting bracket 1306 and may extend substantially perpendicular to the mounting bracket from the top end. Further, the mounting bracket 1306 may include a fixture coupling aperture 1422 disposed below the locator tab 1402. Additionally, the bottom portion of the mounting bracket 1306 may be configured to couple a spring wire form 1308 to the mounting bracket 1306. In particular, the bottom portion of the mounting bracket 1306 may include a wire form coupling aperture 1419 and a pair of alignment tabs 1420 that are disposed above and on either side of the wire form coupling aperture 1419. The alignment tabs 1420 may extend substantially perpendicular to the mounting bracket 1306 from opposite longitudinal edges of the mounting bracket 1306 in a direction that is opposite to that of locator tab 1402.

Further, as illustrated in FIGS. 1 and 2, the spring wire form 1308 may include a curved middle portion 1416 that is bent in the form of an open loop and defines a through opening 1490. Further, the spring wire form 1308 may include a first leg 1408 that extends out from one end of the curved middle portion 1416, and a second leg 1410 that extends out from an opposite end of the curved middle portion 1416 in a direction substantially opposite to that of the first leg 1408. Furthermore, the opposite ends of the first leg 1408 and the second leg 1410, i.e., the ends that are farthest away from each other may be shaped as hooks 1412. Additionally, in the spring wire form 1308, the open side 1492 of the hooks 1412 and the open side 1491 of curved middle portion 1416 face the same direction, i.e., upwards or direction A.

To couple the spring wire form 1308 to the mounting bracket 1306, the ends of the two legs 1408 and 1410 that are adjacent the curved middle portion 1416 are disposed on the alignment tabs 1420 such that the through opening 1490 defined by the curved middle portion 1416 of the spring wire form 1308 is axially aligned with the wire form coupling aperture 1419. Further, a fastener 1310 is passed through the axially aligned through aperture 1490 of the spring wire form 1308 and the wire form coupling aperture 1419 of the mounting bracket 1306 to couple the spring wire form 1308 to the mounting bracket 1306.

Furthermore, the mounting bracket 1306 may be coupled to the finishing cone 1301 by inserting the locator tab 1402 into a locator slot 1404 on the body 1302 of the finishing cone 1301 such that the fixture coupling aperture 1422 of the mounting bracket 1306 is axially aligned with the corresponding through aperture 1406 on the body 1302 of the finishing cone 1301. Further, a fastener 1312 is passed through the axially aligned fixture coupling aperture 1422 of the mounting bracket 1306 and the through aperture 1406 on the body 1302 of the finishing cone 1301 to secure the mounting bracket 1306 to the finishing cone 1301.

Figure 3:
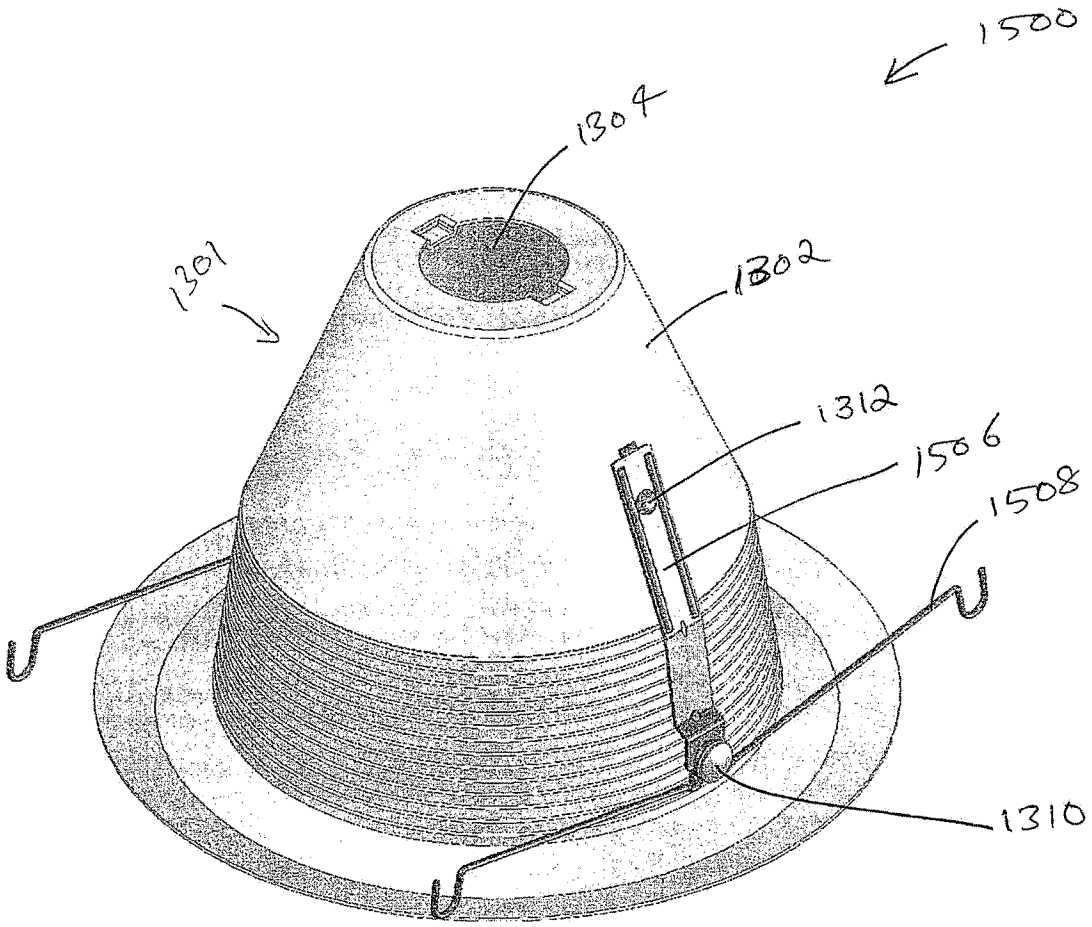
FIG. 3 illustrates a perspective view of the example finishing section of FIG. 1 with a second example retention device, in accordance with example embodiments of the present disclosure.
Figure 4:
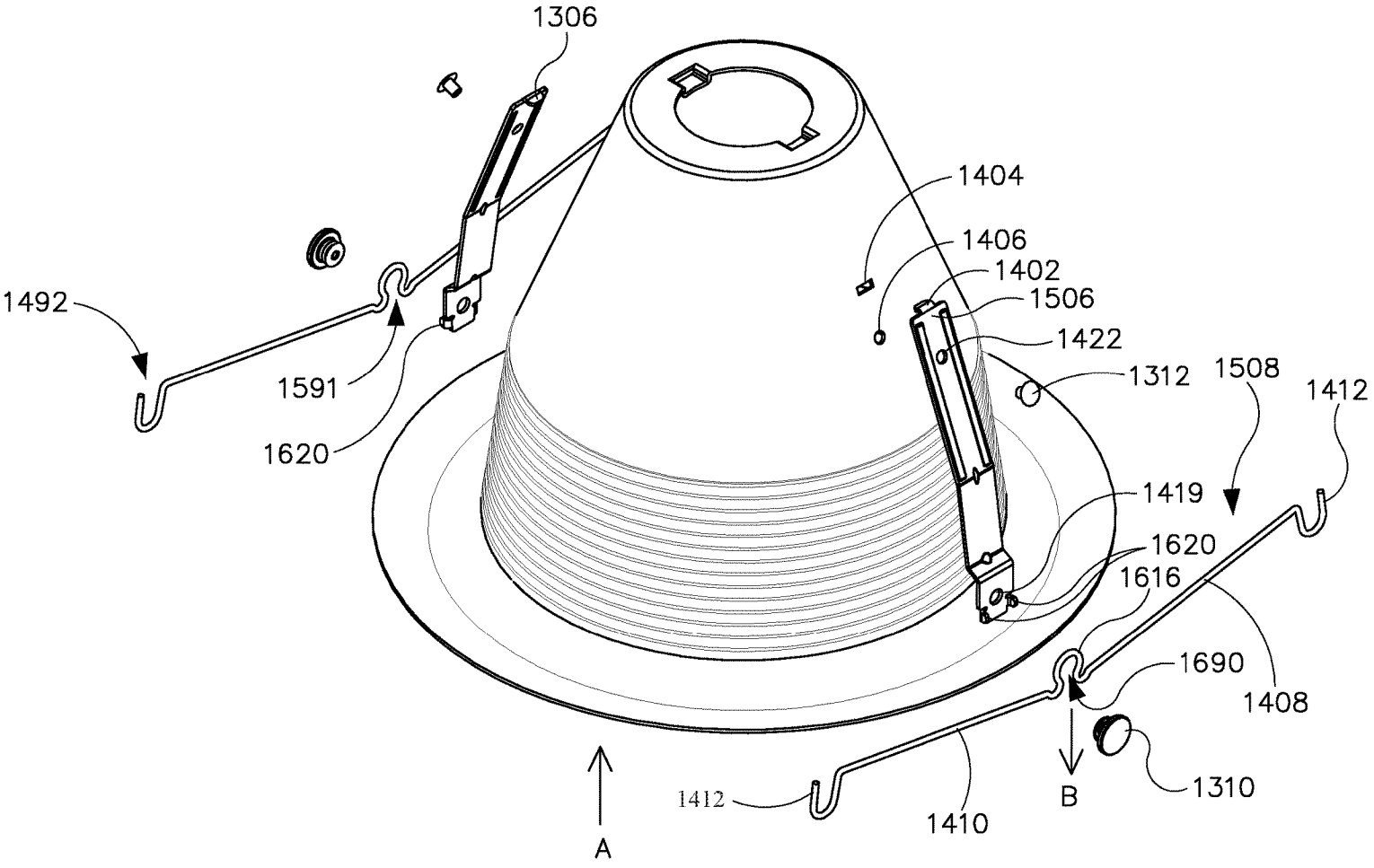
FIG. 4 illustrates an exploded view of the finishing section of FIG. 1 with the second example retention device, in accordance with example embodiments of the present disclosure.

Turning to FIGS. 3 and 4, FIG. 3 illustrates a perspective view of the example finishing section of FIG. 1 with a second example retention device, in accordance with example embodiments of the present disclosure; and FIG. 4 illustrates an exploded view of the finishing section of FIG. 1 with the second example retention device, in accordance with example embodiments of the present disclosure.

The finishing section 1500 of FIGS. 3 and 4 may be substantially similar to the finishing section 1300 of FIGS. 1 and 2, except the bottom portion of the mounting bracket and the spring wire form. In particular, in FIGS. 3 and 4, the bottom portion of the mounting bracket 1506 that is configured to couple a spring wire form 1508 to the mounting bracket 1506 may include a wire form coupling aperture 1419 and a pair of alignment tabs 1620 that are disposed below and on either side of the wire form coupling aperture 1419. The alignment tabs 1620 may extend substantially perpendicular to the mounting bracket 1506 from opposite longitudinal edges of the mounting bracket 1506 in a direction that is opposite to that of locator tab 1402.

Further, the spring wire form 1508 of FIGS. 3 and 4 may be different from the spring wire form 1308 of FIGS. 1 and 2 in that the open side 1591 of the curved middle portion 1616 that forms the open loop and defines the through aperture 1690 may face an opposite direction, e.g., direction B, compared to the direction of the open side 1492 of the hooks 1412 at the ends of the first and second legs 1408 and 1410, e.g., direction A. In other words, the curved middle portion 1616 of the spring wire form 1508 in FIGS. 3 and 4 extends upwards, while the curved middle portion 1416 of the spring wire form 1308 in FIGS. 1 and 2 extends downwards.

The alignment tabs 1620 may be configured to axially align the through aperture 1690 defined by the curved middle portion 1616 of the spring wire form 1508 with the wire form coupling aperture 1419 of the mounting bracket 1506. Further, the two legs 1408 and 1410 of the spring wire form 1508 may be disposed below the alignment tabs 1620. Furthermore, the fastener 1310 may be passed through the axially aligned through aperture 1690 of the spring wire form 1508 and the wire form coupling aperture 1419 of the mounting bracket 1506 to couple the spring wire form 1508 to the mounting bracket 1506. The coupling of the mounting bracket 1506 to the finishing cone 1301 may be substantially similar to that in FIGS. 1 and 2 described above and will not be repeated for the sake of brevity.

Even though FIGS. 1-4 illustrate spring wire forms that are configured to be coupled to the mounting bracket using fasteners 1310, such as rivets, or screws, one of ordinary skill in the art can understand and appreciate that in other example embodiments, the spring wire forms may be configured to couple to the mounting bracket using any other appropriate coupling means without departing from a broader scope of the present disclosure. For example, the spring wire forms may be configured to directly attach to the mounting bracket without any fasteners, as illustrated in FIGS. 5-10 that are described below in greater detail.

Figure 5:
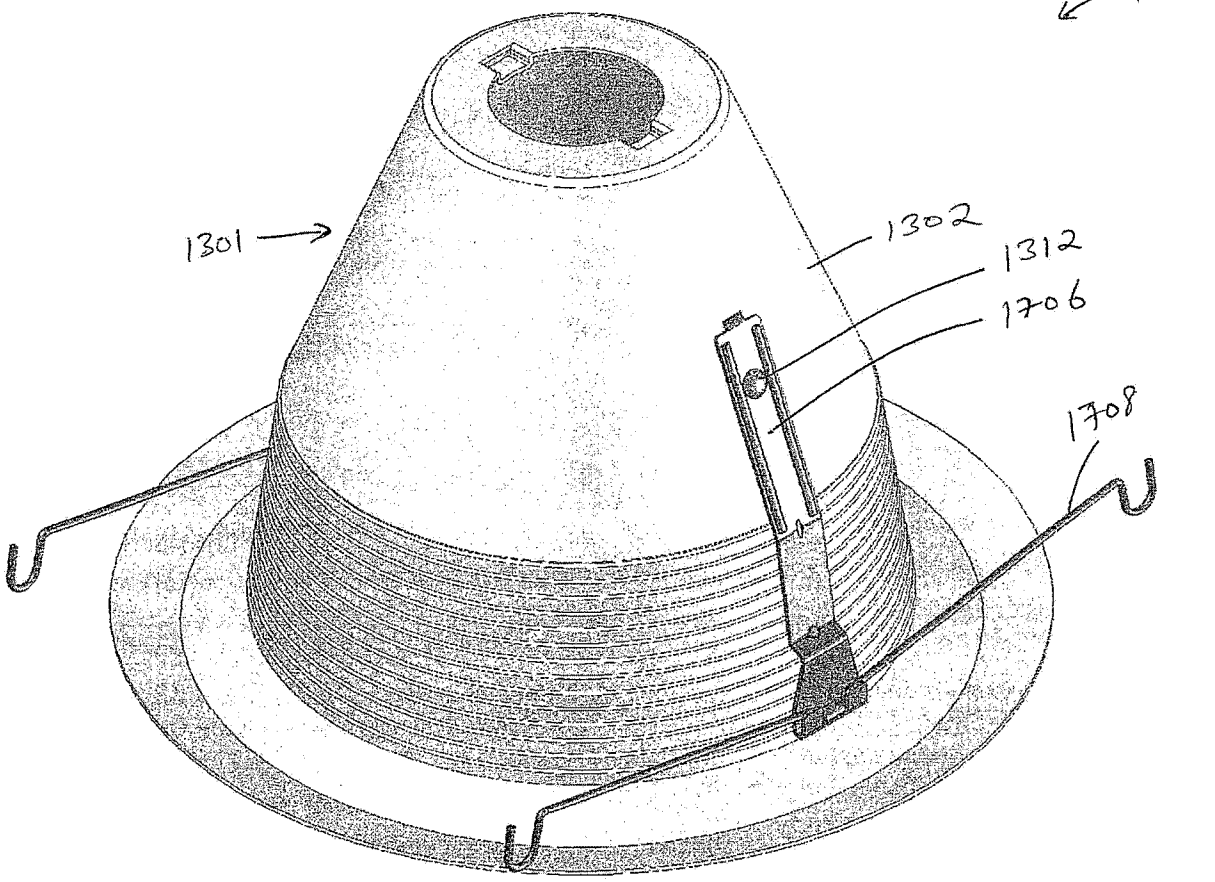
FIG. 5 illustrates a perspective view of the example finishing section of FIG. 1 with a third example retention device, in accordance with example embodiments of the present disclosure.
Figure 6:
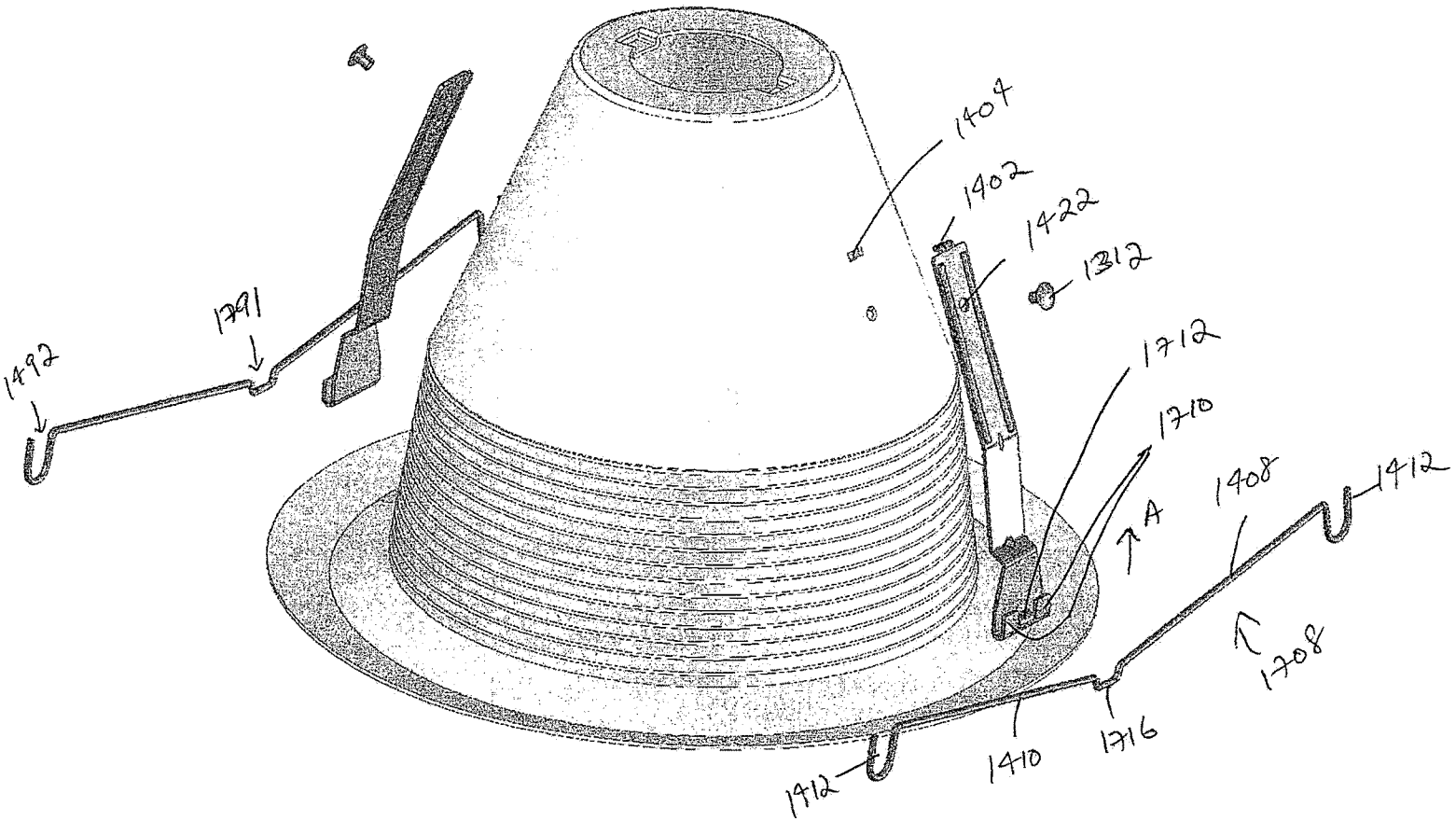
FIG. 6 illustrates an exploded view of the finishing section of FIG. 1 with the third example retention device, in accordance with example embodiments of the present disclosure.
Figure 7:
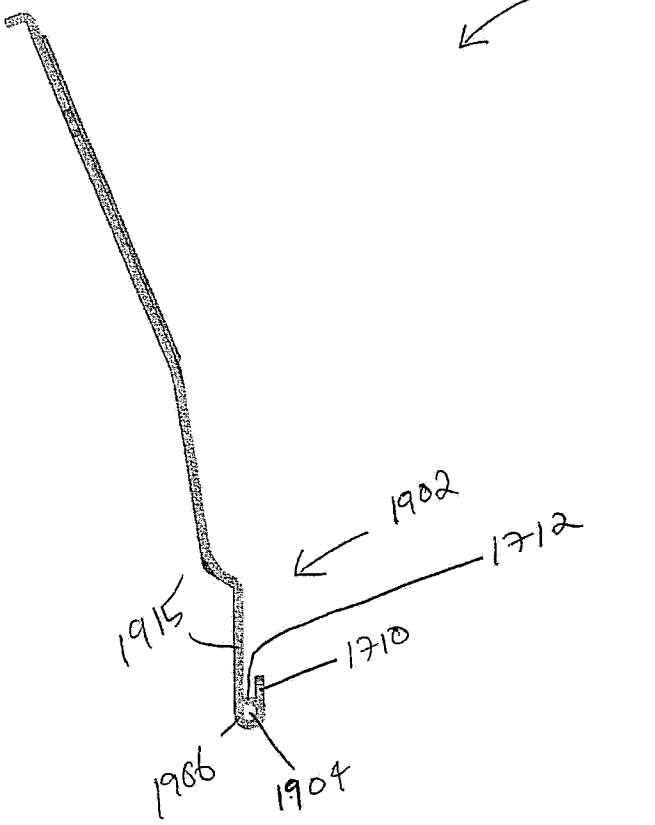
FIG. 7 illustrates a side view of the coupling bracket associated with the third example retention device, in accordance with example embodiments of the present disclosure.

Turning to FIGS. 5-7, FIG. 5 illustrates a perspective view of the example finishing section of FIG. 1 with a third example retention device, in accordance with example embodiments of the present disclosure; FIG. 6 illustrates an exploded view of the finishing section of FIG. 1 with the third example retention device, in accordance with example embodiments of the present disclosure; and FIG. 7 illustrates a side view of the coupling bracket associated with the third example retention device, in accordance with example embodiments of the present disclosure.

Referring to FIGS. 5-7, the spring wire form 1708 may include a substantially U-shaped middle portion 1716 (herein 'middle portion'), a first leg 1408 extending from the first end of middle portion 1716 in a first direction, and a second leg 1410 extending from the second end of middle portion 1716 in a second direction that is substantially opposite to the first direction. Further, the opposite ends of the first leg 1408 and the second leg 1410, i.e., the ends that are farthest away from each other may be shaped as hooks 1412. Furthermore, the open side 1492 of the hooks 1412 and the open side 1791 of middle portion 1416 face the same direction, i.e., upwards or direction A.

As illustrated in FIGS. 5-7, the bottom portion 1902 of the mounting bracket 1706 may be configured to receive and securely couple the spring wire form 1708 to the mounting bracket 1706. In particular, the bottom portion 1902 of the mounting bracket 1706 may include two end flanges 1710 that extend out and upward in a direction that is substantially parallel to the body 1915 of the mounting bracket 1706 from opposite ends of the mounting bracket's bottom edge 1906. In other words, the two end flanges 1710 may have a substantially U-shaped cross-sectional profile. Further, the bottom portion 1902 of the mounting bracket 1706 may include a middle flange 1712 that is disposed between the two end flanges 1710 and has a substantially C-shaped cross-sectional profile. That is, the middle flange 1712 may extend out and back towards the body 1915 of the mounting bracket 1706 in a direction that is substantially perpendicular to the body 1915 of the mounting bracket 1706.

The middle portion 1716 of the spring wire form 1708 may be disposed within a cavity 1904 defined by the middle flange 1712 to securely couple the spring wire form 1708 to the mounting bracket 1706. In particular, as illustrated in FIG. 5, the spring wire form 1708 may be disposed within the cavity 1904 such that both the legs 1408 and 1410 of the spring wire form 1708 may extend out from the middle flange 1712. Further, in certain example embodiments, the middle portion 1716 of the spring wire form 1708 may be disposed in the cavity 1904 defined by the middle flange 1712 of the mounting bracket 1706 by pushing the middle portion 1716 of the spring wire form 1708 over the middle flange 1712 such that it snaps into the cavity 1904 defined by the middle flange 1712 of the mounting bracket 1706. Accordingly, the flanges 1712 and/or 1710 of the mounting bracket 1706 may be made flexible to bend as needed.

Figure 8:
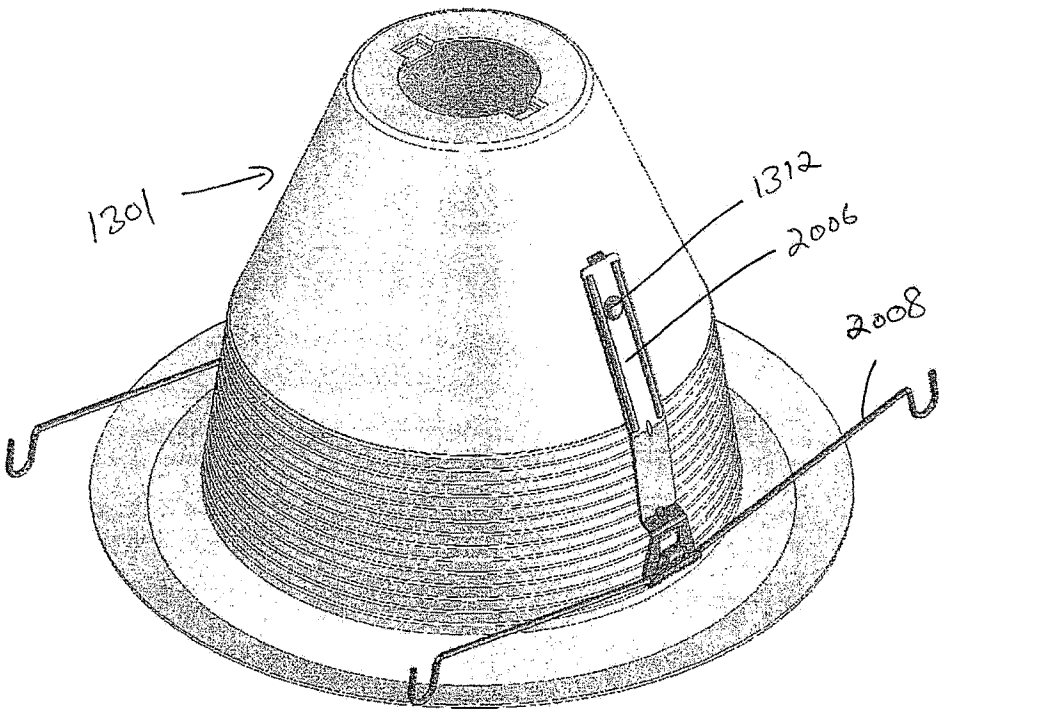
FIG. 8 illustrates a perspective view of the example finishing section of FIG. 1 with a fourth example retention device, in accordance with example embodiments of the present disclosure.
Figure 9:
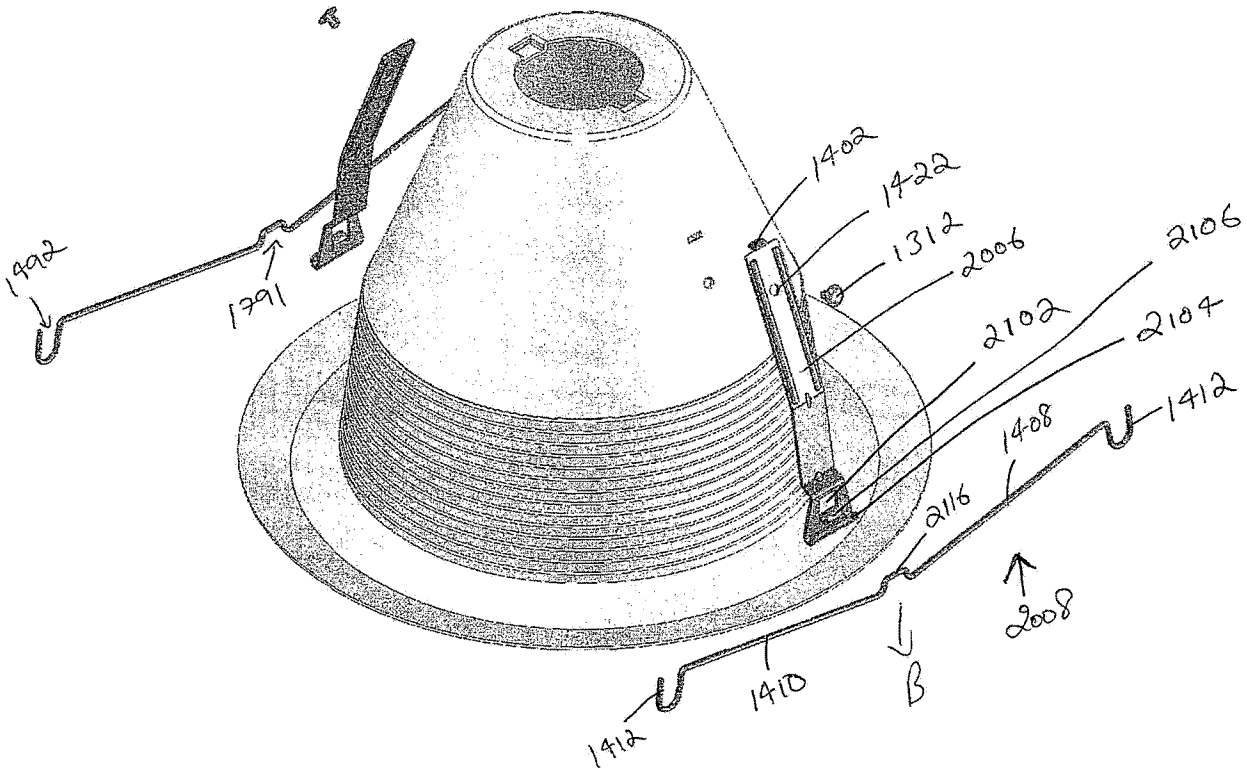
FIG. 9 illustrates an exploded view of the finishing section of FIG. 1 with the fourth example retention device, in accordance with example embodiments of the present disclosure.
Figure 10:
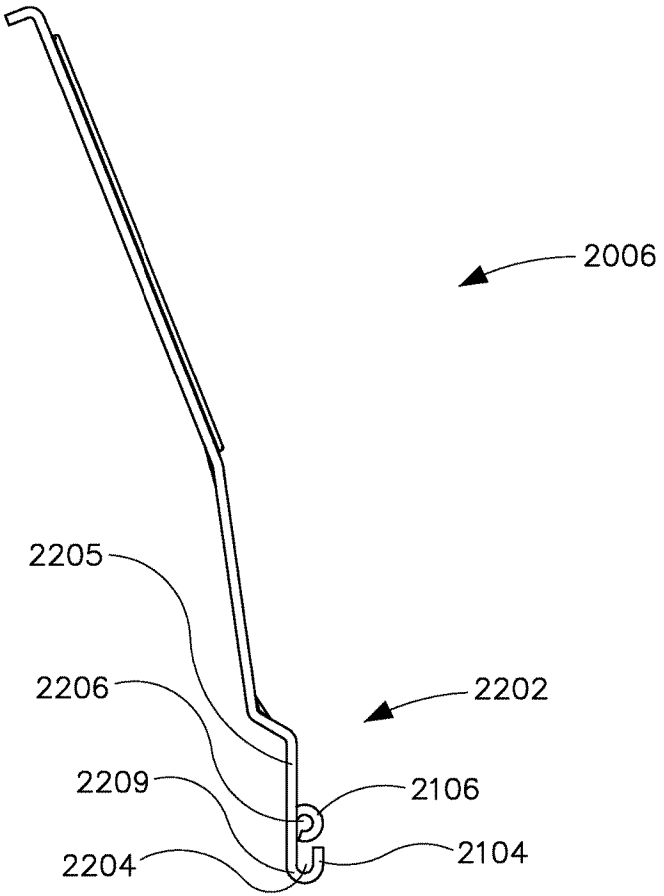
FIG. 10 illustrates a side view of the coupling bracket associated with the fourth example retention device, in accordance with example embodiments of the present disclosure.

Turning now to FIGS. 8-10, FIG. 8 illustrates a perspective view of the example finishing section of FIG. 1 with a fourth example retention device, in accordance with example embodiments of the present disclosure; FIG. 9 illustrates an exploded view of the finishing section of FIG. 1 with the fourth example retention device, in accordance with example embodiments of the present disclosure; and FIG. 10 illustrates a side view of the coupling bracket associated with the fourth example retention device, in accordance with example embodiments of the present disclosure.

The spring wire form 2008 of FIGS. 8-10 may be different from the spring wire form 1708 of FIGS. 5-7 in that the middle portion 2116 of the spring wire form 2008 may have a substantially inverted U-shape. That is, the open side 1791 of the middle portion 2116 may face an opposite direction, e.g., direction B, compared to the direction of the open side 1492 of the hooks 1412 at the ends of the first and second legs 1408 and 1410, e.g., direction A.

Further, the bottom portion 2202 of the mounting bracket 2006 in FIGS. 8-10 may include a through aperture 2102, and pair of flanges 2104 and 2106 disposed below the through aperture 2102. The pair of flanges 2104 and 2106 may be configured to couple the spring wire form 2008 to the mounting bracket 2006. In particular, the pair of flanges may include a bottom flange 2104 that has a substantially U-shaped cross-sectional profile and defines a cavity 2204. The bottom flange 2104 may extend out and upward along the entire length of the mounting bracket's bottom edge 2209 and in a direction that is substantially parallel to the body 2205 of the mounting bracket 2006. Furthermore, the pair of flanges may include an upper flange 2106 that has a substantially C-shaped cross-sectional profile and defines a cavity 2206. The upper flange 2106 may be disposed above the bottom flange 2104 and facing the bottom flange 2104. Specifically, as illustrated in FIGS. 9 and 10, the upper flange 2106 may extend out and back towards the body 2205 of the mounting bracket 2006.

As illustrated in FIGS. 8-10, the middle portion 2116 of the spring wire form 2008 may be disposed within the cavity 2206 defined by the upper flange 2106 to securely couple the spring wire form 2008 to the mounting bracket 2006. In particular, as illustrated in FIG. 8, the spring wire form 2008 may be disposed within the cavity 2206 such that both the legs 1408 and 1410 of the spring wire form 2008 may extend downward and out from the upper flange 2106. Further, in certain example embodiments, the middle portion 2116 of the spring wire form 2008 may be disposed in the cavity 2206 defined by the upper flange 2106 of the mounting bracket 2006 by initially pushing and consequently snapping the middle portion 2116 of the spring wire form 2008 into the cavity 2204 defined by the bottom flanges 2104 and then pulling the middle portion 2116 of the spring wire form 2008 up against the upper flange 2106 such that the middle portion 2116 of the spring wire form 2008 snaps into the cavity 2206 defined by the upper flange 2106 of the mounting bracket 2006. Accordingly, the flanges 2106 and/or 2104 of the mounting bracket 2006 may be made flexible to bend as needed.

Even though FIGS. 1-10 illustrate single piece spring wire forms (the curved portion, the legs, and the hook ends forming a single continuous body), one of ordinary skill in the art can understand and appreciate that multi-part spring wire forms are within the broader scope of the present disclosure. For example, in some example embodiments, the spring wire forms may be two-part spring wire forms as illustrated in FIGS. 12-15 that are described below in greater detail.

Figure 12:
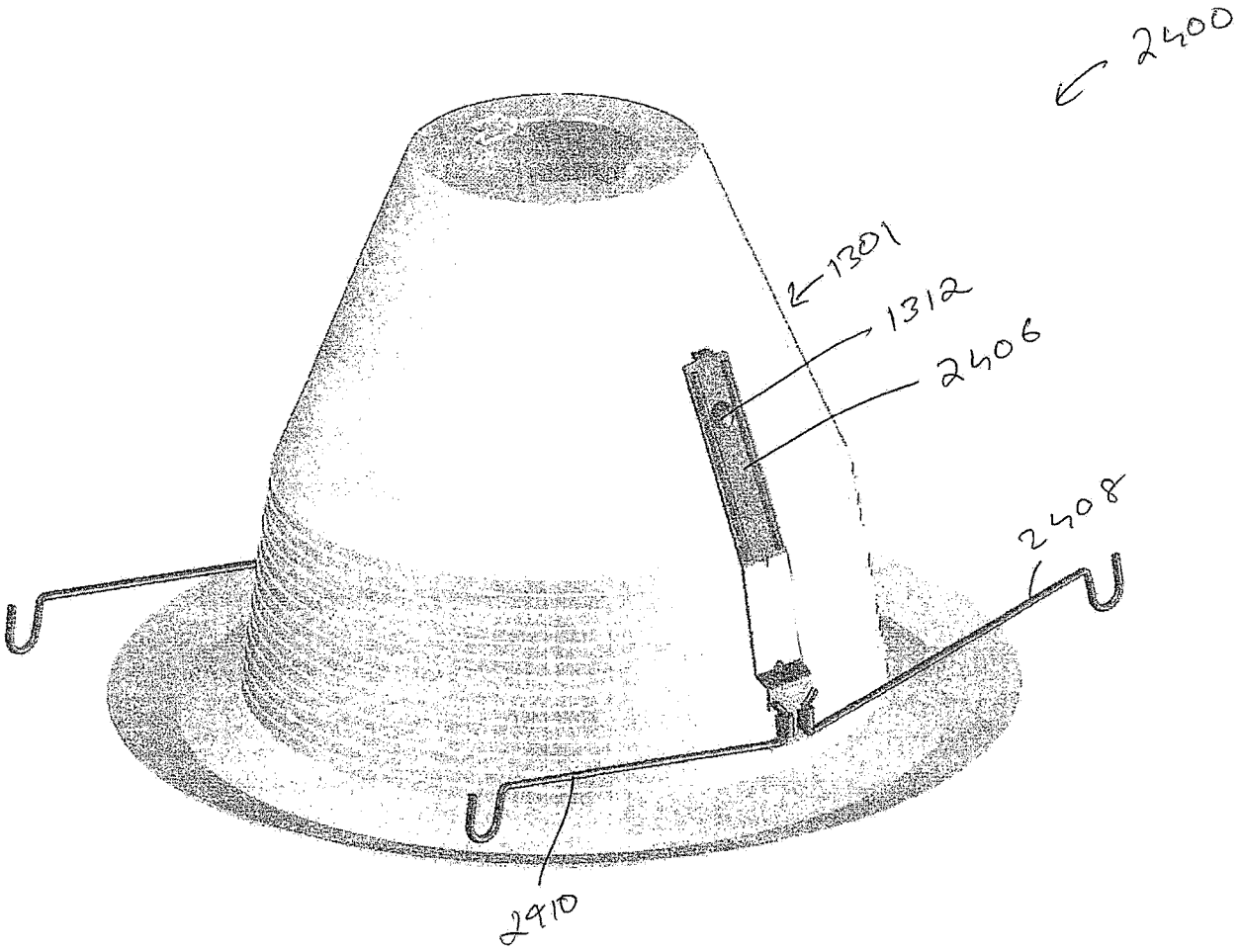
FIG. 12 illustrates a perspective view of the example finishing section of FIG. 1 with a first example two-part retention device, in accordance with example embodiments of the present disclosure.
Figures 10, 13:
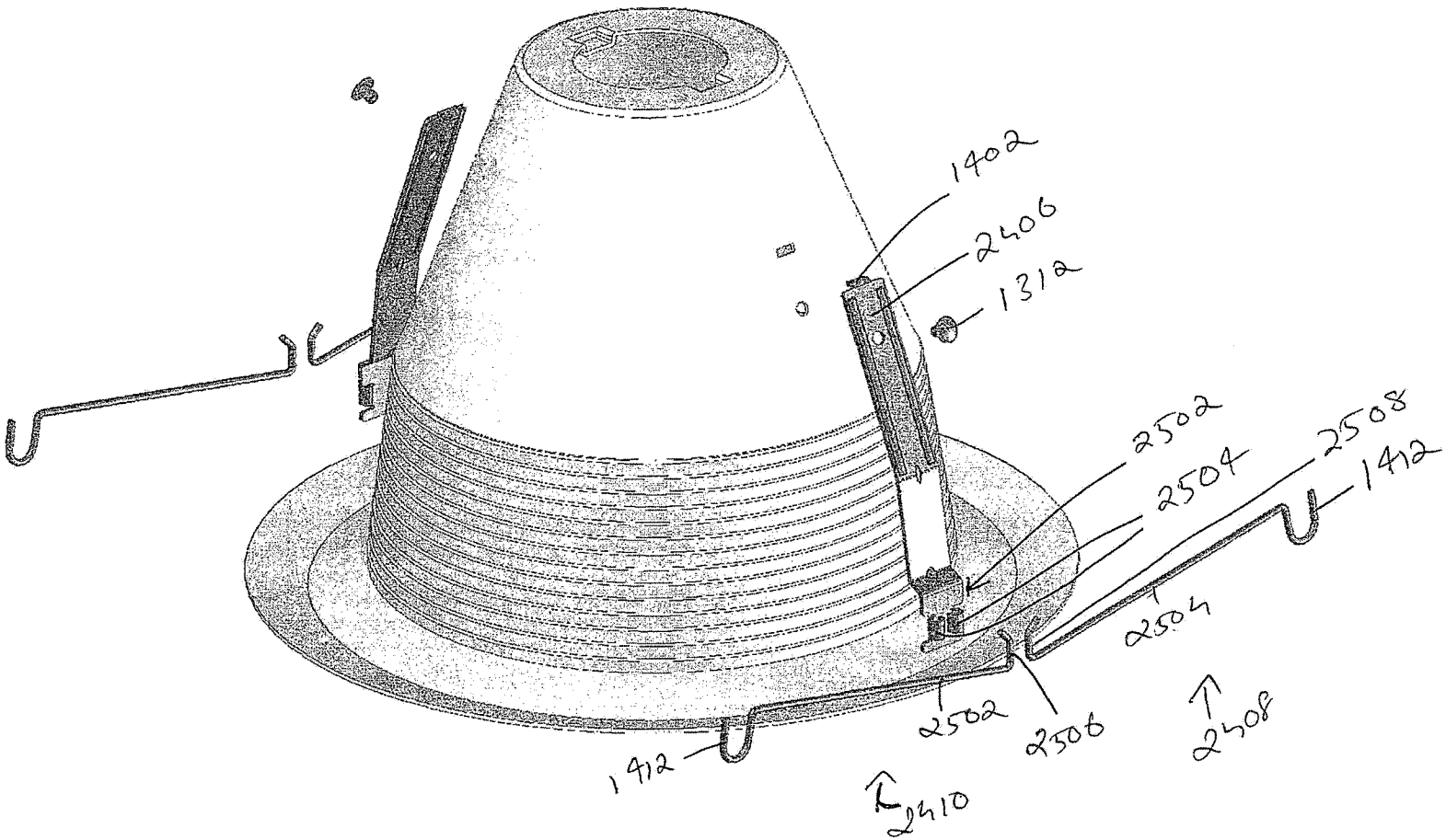
FIG. 13 illustrates an exploded view of the finishing section of FIG. 1 with the first example two-part retention device, in accordance with example embodiments of the present disclosure.
Figure 14:
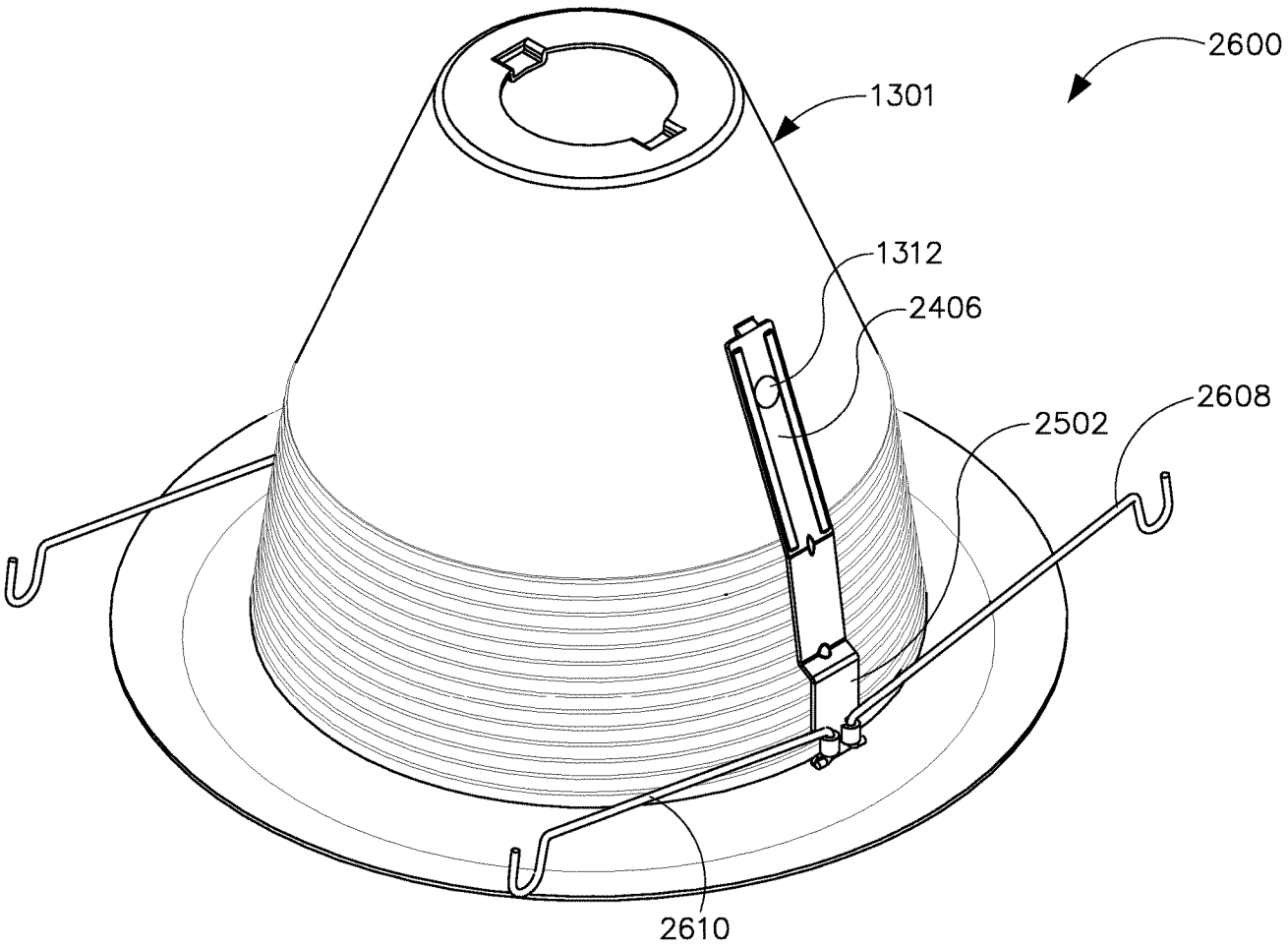
FIG. 14 illustrates a perspective view of the example finishing section of FIG. 1 with a second example two-part retention device, in accordance with example embodiments of the present disclosure.

Turning to FIGS. 12-15, FIG. 12 illustrates a perspective view of the example finishing section of FIG. 1 with a first example two-part retention device, in accordance with example embodiments of the present disclosure; FIG. 13 illustrates an exploded view of the finishing section of FIG. 1 with the first example two-part retention device, in accordance with example embodiments of the present disclosure;

FIG. 14 illustrates a perspective view of the example finishing section of FIG. 1 with a second example two-part retention device, in accordance with example embodiments of the present disclosure; and FIG. 15 illustrates an exploded view of the finishing section of FIG. 1 with the second example two-part retention device, in accordance with example embodiments of the present disclosure.

Referring to FIGS. 12-15, finishing sections 2400 and 2600 may include a finishing cone 1301 and a mounting bracket 2406 that is coupled to the finishing cone using a locator tab 1402 of the mounting bracket 2406 and a fastener 1312. Further, the mounting bracket 2406 may include a pair of clamps 2504 disposed at the bottom surface of the mounting bracket 2406. The pair of clamps 2504 of the mounting bracket 2406 may be configured to couple a first example two-part spring wire form 2408 and 2410 or a second example two-part wire form 2608 and 2610 to the mounting bracket 2406 as illustrated in FIGS. 12 and 14.

In particular, the first example two-part spring wire form illustrated in FIGS. 12 and 13 may include a first leg 2502 and a second leg 2504 that are separate from each other. A first end of each leg 2502 and 2504 of the first example two-part spring wire form may have a hook 1412, and an opposite second end (2506, 2508) of each leg 2502 and 2504 may be bent upwards such that it is substantially perpendicular to the respective leg. The second example two-part spring wire form illustrated in FIGS. 14 and 15 may be different from the first example two-part spring wire form in that the second ends (2706, 2708) of the first leg 2702 and a second leg 2704 in the second example two-part spring wire form may be bent downwards such that it is substantially perpendicular to the respective leg.

In either case, the first example two-part spring wire form (2408, 2410) and the second example two-part spring wire form (2608, 2610) may be coupled to the mounting bracket 2406 by clamping the second ends (2506, 2508) of each leg 2502 and 2504 of the first example two-part spring wire form (2408, 2410) or the second ends (2706, 2708) of the each leg 2702 and 2704 of the second example two-part spring wire form (2608, 2610) to the mounting bracket 2406 using the pair of clamps 2504. In particular, the first leg and second leg of the first example two-part spring wire form (2408, 2410) and/or the second example two-part spring wire form (2608, 2610) may be coupled to the mounting bracket 2406 such that they extend away from each other in opposite directions, as illustrated in FIGS. 12-15.

Even though the present disclosure describes the spring wire forms as coupled to the mounting bracket, one or ordinary skill in the art can understand and appreciate that in other example embodiments, the mounting brackets may be omitted and instead the spring wire forms may be directly coupled to the body of the finishing cone without departing from a broader scope of the present disclosure. One of ordinary skill in the art can understand and appreciate the wire forms are not limited to the spring wire forms described herein, and may include any other appropriate type of wire form without departing from a broader scope of the present disclosure. For example, the wire form may include coiled wire forms as illustrated in FIG. 11 and a diamond shaped wire form as illustrated in FIGS. 17-28 that are described below in greater detail.

ii. Coiled Wire Form

Figure 11:
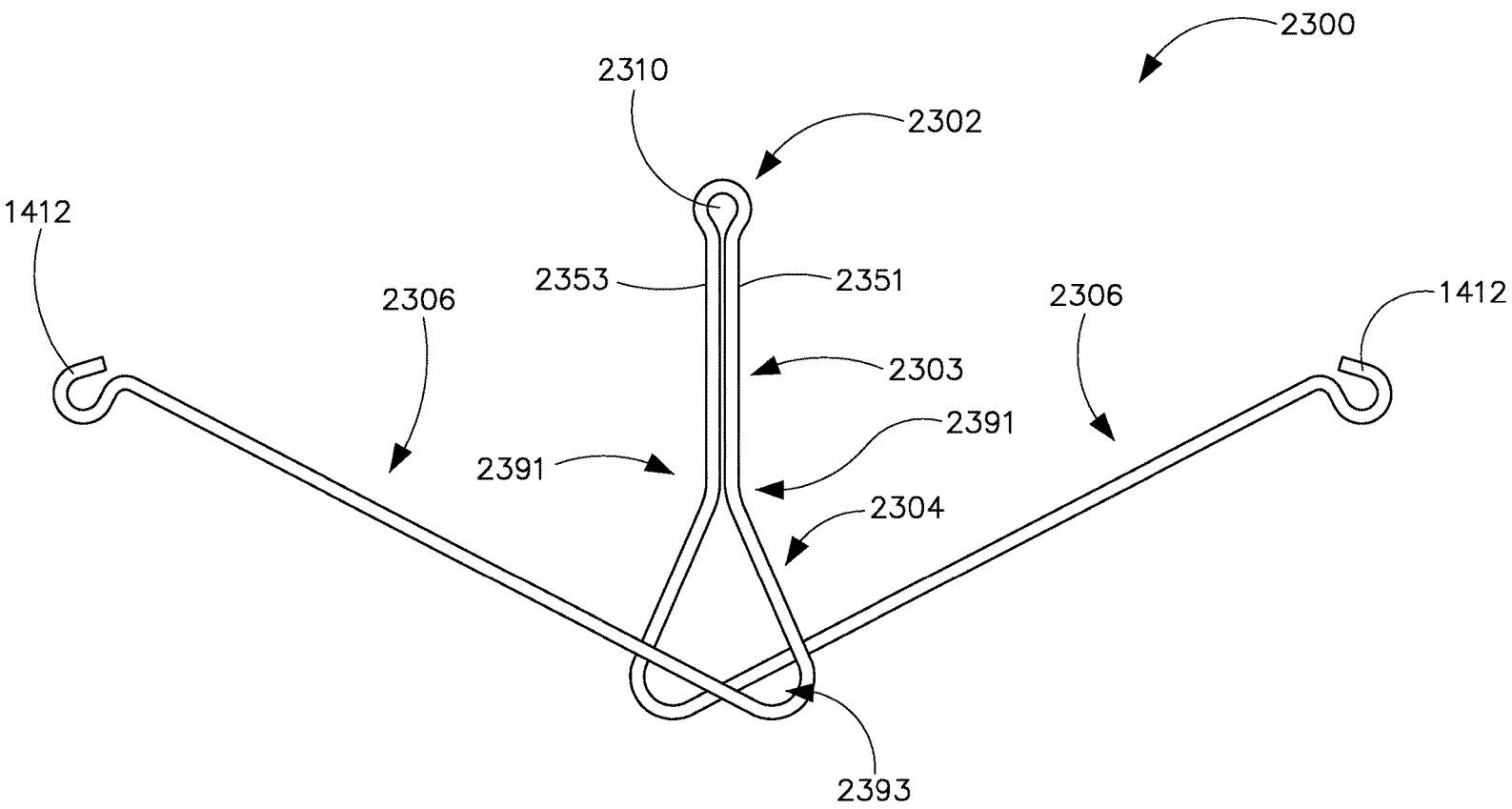
FIG. 11 illustrates a front view of a fifth example retention device, in accordance with example embodiments of the present disclosure.

Referring to FIG. 11, the coiled wire form 2300 may include a curved top section 2302 that is configured to form an open loop. Further, the curved top section 2302 may define a coupling through aperture 2310 that is configured to receive a fastener therethrough to couple the coiled wire form 2300 to a finishing cone either directly or via a mounting/coupling bracket. In addition to the curved top section 2302, the coiled wire form 2300 may include a first leg 2351 and a second leg 2353. As illustrated in FIG. 11, a first end of each leg 2351 and 2353 may be joined to a respective end of the curved top portion 2302 and the opposite second end 1412 of each leg 2351 and 2553 may be hook shaped. In between the first end that is joined with an end of the curved top section 2302 and the opposite hooked end 1412, each leg 2351 and 2353 may include a first vertical portion 2303, a second bent portion 2304 that extends from the first vertical portion 2303 at an obtuse angle 2391 to the first vertical portion 2303, and a third bent portion 2306 that extends from the second bent portion 2304 at an acute angle 2393 to the second bent portion 2304.

The first linear portion 2303 of both the legs 2351 and 2353 may extend down from the respective ends of the curved top section 2303 such that they are substantially parallel and adjacent to each other. Further, the first linear portion 2303 of each leg 2351 and 2353 may transition into a second bent portion 2304 that extends further downwards and where the legs 2351 and 2353 extend away from each other. Then, each leg 2351 and 2353 transitions from the second downward bent portion 2304 to a third upward bent portion 2306 where each leg 2351 and 2353 is bent upwards and in an opposite direction towards the other leg. The second downward bent portion 2304 and third upward bent portion 2306 of one leg may be disposed behind the other leg, as illustrated in FIG. 11. In certain example embodiments, the coiled wire form 2300 may be a type of spring wire form. Accordingly, the coiled wire form 2300 may operate like a spring wire form where the third upward bent portion 2306 of both the legs 2351 and 2353 is pinched together or compressed and the hooked ends 1412 are coupled to the wire form receivers 404 in the recessed housing can 410. Then, the legs 2351 and 2353 are released to expand back to the default position, thereby pulling up the finishing cone of the finishing section further into the recessed housing can 410.

iii. Substantially Diamond Shaped Wire Forms

Figure 17:
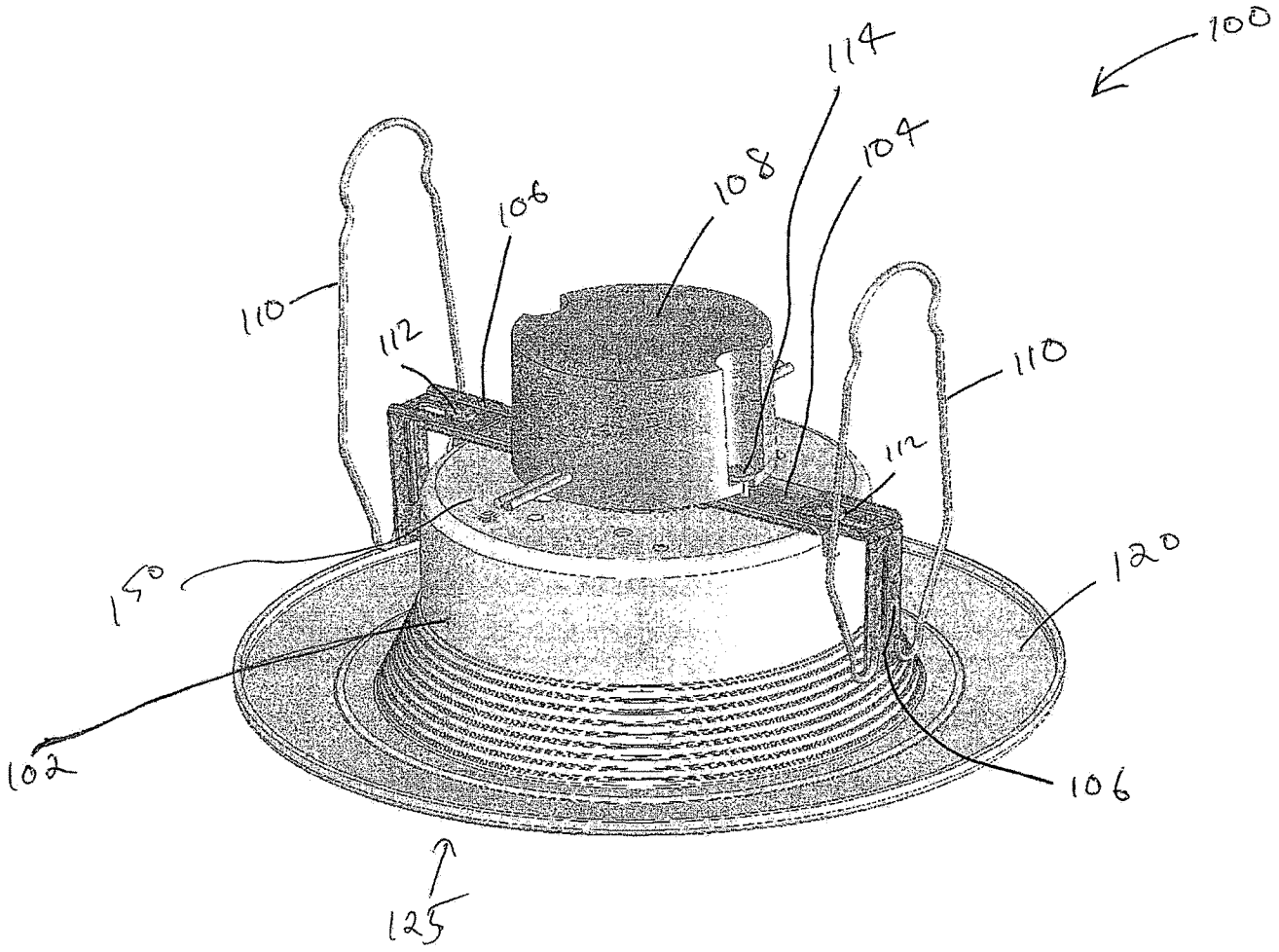
FIG. 17 illustrates a perspective view of a finishing section with a sixth example retention device, in accordance with example embodiments of the present disclosure.
Figure 18:
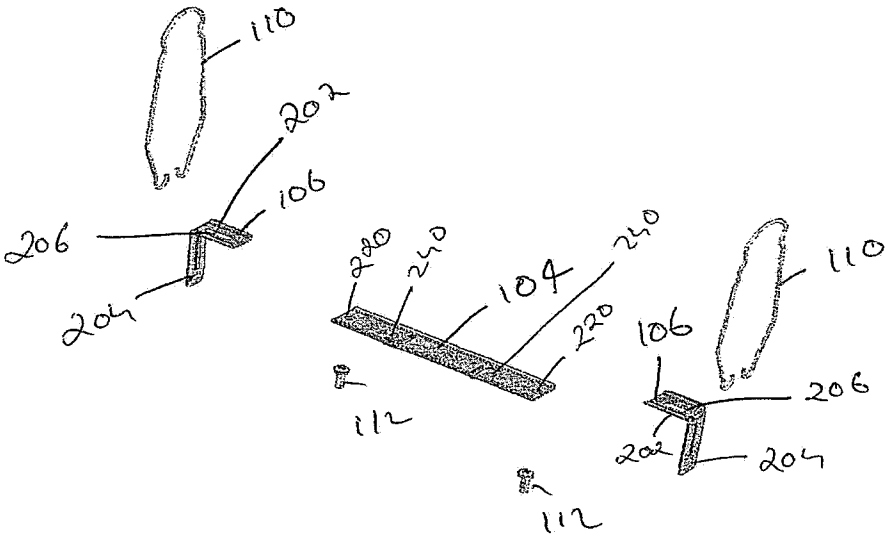
FIG. 18 illustrates an exploded view of a mounting device and the sixth example retention device, in accordance with example embodiments of the present disclosure.
Figure 19:
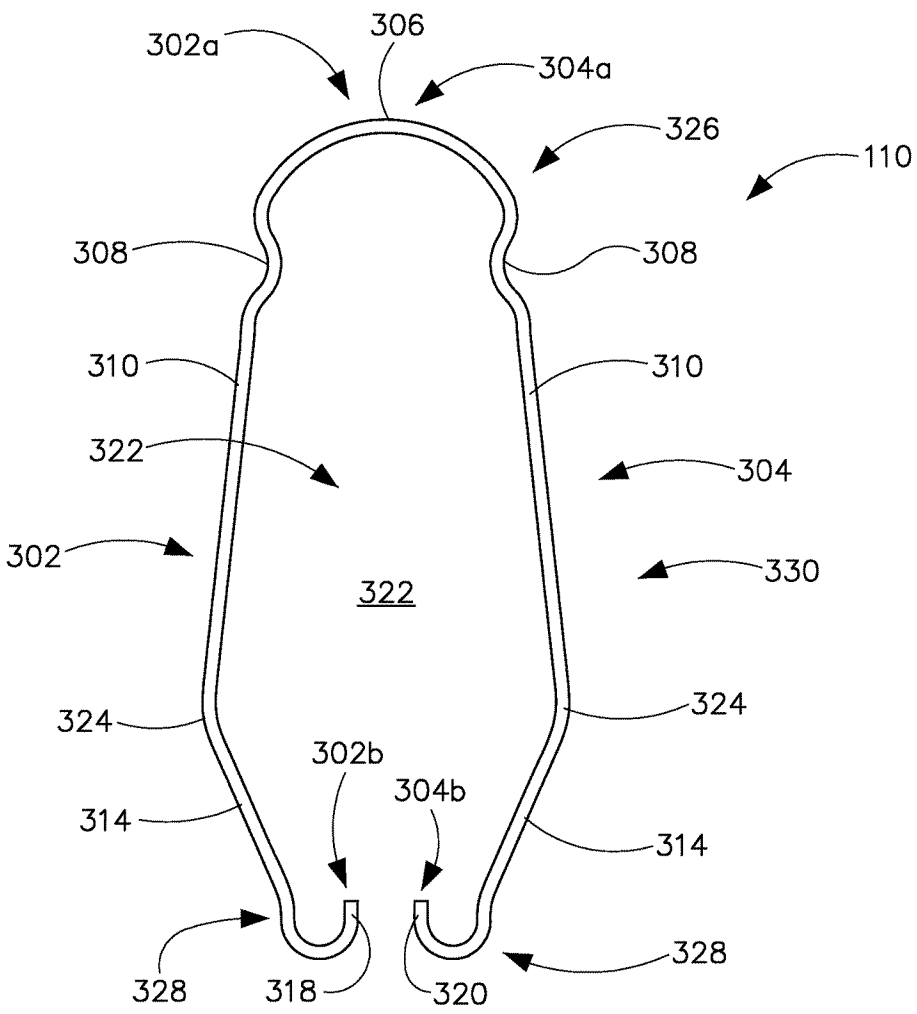
FIG. 19 illustrates a front view of the sixth example retention device of FIG. 17, in accordance with example embodiments of the present disclosure.

FIG. 17 illustrates a perspective view of a finishing section with a sixth example retention device, in accordance with example embodiments of the present disclosure; FIG. 18 illustrates an exploded view of a mounting device and the sixth example retention device, in accordance with example embodiments of the present disclosure; FIG. 19 illustrates a front view of the sixth example retention device of FIG. 20, in accordance with example embodiments of the present disclosure; and FIGS. 21A and 21B (collectively 'FIG. 21') illustrate a retention of a finishing section in a recessed housing can using the sixth example retention device of the finishing section and the receiver features of the recessed housing can, in accordance with example embodiments of the present disclosure.

Referring to FIGS. 17-20, a finishing section 100 may include a finishing cone 102 and a trim flange 120 that is disposed at a bottom portion of the finishing cone 102. The trim flange 120 extends radially outward from the finishing cone 102. In the finishing section 100 illustrated in FIG. 17, the trim flange 120 is integral with the finishing cone 102. However, in other example embodiments, the trim flange 120 or a trim body may be removably coupled to the finishing cone without departing from a broader scope of the present disclosure. In particular, the finishing cone 102 may be configured to house a light source in an internal cavity 125 defined by an inner surface of the finishing cone 102. Further, the finishing section 100 may include a mounting plate 104 that is disposed on and coupled to the top surface 150 of the finishing cone 102. The mounting plate 104 may be configured to couple a junction box 108 to the finishing cone 102 via fasteners 114 and a first set of through apertures 240 of the mounting plate 104 as illustrated in FIG. 17. Furthermore, as illustrated in FIGS. 17 and 18, the finishing section 100 may include a pair of wire form coupling brackets 106 (herein 'coupling brackets') that are coupled to the finishing cone 102 via the mounting plate 104 using fasteners 112 and the through apertures 220 on the mounting plate 104. The finishing section 100 also includes a pair of substantially diamond shaped wire forms 110 (herein 'diamond wire form'), each diamond wire form 110 coupled to a respective coupling bracket 106 as illustrated in FIG. 17.

In particular, each coupling bracket 106 may include a first planar surface 202 and a second planar surface 204 that extends substantially perpendicular to the first planar surface 202 from one end of the first planar surface 202. The first planar surface 202 includes an elongated through slot 206 that is substantially parallel to the longitudinal edges of the first planar surface 202. Further, the coupling bracket 106 may include flanges 604 (shown in FIGS. 22A, 24A, 26A, and 28A) extending substantially perpendicular to the first planar surface 202 from the longitudinal edges of the first planar surface 302. The flanges 604 may extend in a direction that is opposite to the direction in which the second planar surface 302 extends.

To attach the coupling bracket 106 to the finishing cone 102, the first planar surface 202 of the coupling bracket 106 may be disposed on the mounting plate 104 (that is attached to the finishing cone 102) such that the through slot 206 on the first planar surface 202 of the coupling bracket 106 axially aligns with the through aperture 220 of the mounting plate 104. Then, a fastener 112 may be passed through the axially aligned slot 206 of the coupling bracket and through aperture 220 of the mounting plate 104 to secure the coupling bracket 106 to the mounting plate 104. The coupling bracket 104 may be configured to mount the finishing section 100 within recessed housing cans having different diameters. For example, when the coupling bracket 106 is attached to the mounting plate 104 by passing the fastener 112 through one end of the elongated slot 206 (end that is away from the second planar surface 204), the finishing section 100 may be configured to be coupled to a recessed housing can having a first diameter, e.g., a six inch diameter can. To couple the finishing section 100 to a recessed housing can having a smaller second diameter, e.g., five inch diameter can, the fastener 112 may be partially loosened and the coupling bracket 106 may be pushed towards the finishing cone 102 such that the fastener slides along the elongated slot 206 towards an opposite end of the slot 206 (end adjacent the second planar surface 204). Subsequently, the fastener 112 is tightened at the opposite end of the elongated slot 206.

Further, the second planar surface 204 of the coupling bracket 106 may be configured to couple or attach the diamond wire form 110 to the coupling bracket 106. In particular, in the example embodiment illustrated in FIG. 17, each diamond wire form 110 may be attached to the second planar surface 204 of its respective coupling bracket 106 by welding the diamond wire form onto the second planar surface 204 of the coupling bracket 106.

In certain example embodiments, as illustrated in FIG. 17, the diamond wire form 110 may be coupled to the second planar surface 302 of the coupling bracket 106 adjacent a lateral end of the second planar surface 204 that is away from the first planar surface 202. However, in other example embodiments, the diamond wire form 110 may be coupled to any other portion on the second planar surface 204 or the first planar surface 202 of the coupling bracket 106 without departing from a broader scope of the present disclosure.

As illustrated in FIG. 19, the diamond wire form 110 may include a first leg 302 and a second leg 304 that may be joined at a first end (302*a*, 304*a*) to form an apex 306. Further, the second ends (302*b*, 304*b*) of the first leg 302 and second leg 304 may not be joined. Furthermore, the first leg 302 and the second leg 304 may be arranged such that they face each other and define an opening 322.

Even though the present disclosure describes the diamond wire form as having a first leg and a second leg that are coupled to each other to form the diamond wire form, one of ordinary skill in the art can understand and appreciate that in other example embodiments, the first leg and the second leg may be integral with each other without departing from a broader scope of the present disclosure. That is, the diamond wire form may be a single integral piece. For example, the diamond wire form may be single wire that is bent into a form as seen in FIGS. 19, 22B, 24B, 26B, and/or 28B. Further, one of ordinary skill in the art can understand and appreciate that the wire may possess the proper and usual degree of spring or resiliency to cause the several parts of the diamond wire form to resume or tend to resume their normal relative positions when bent or forced out of them.

In particular, the first leg 302 and the second leg 304 of the diamond wire form 110 illustrated in FIG. 17 may be joined at the first end (302*a*, 304*a*) such that they define a curved top portion 326, an angled middle body portion 330, and a bottom portion 328. Further, diamond wire form 110 may include a bent-in portion 308 that is disposed between the angled middle portion 330 and the curved top portion 326. As illustrated in FIG. 19, at the bent-in portion 308, the first leg 302 and the second leg 304 may be curved inwards towards the cavity 322 and towards each other. Even though the present disclosure describes the diamond wire form 110 as having the bent-in portion 308, one of ordinary skill in the art can understand and appreciate that in other example embodiments, the bent-in portion may be absent without departing from a broader scope of the present disclosure. That is, in said other example embodiments, the design of the diamond wire form 110 may have a smooth transition from the curved top portion 326 to the angled middle body portion 330 without any inward facing bends.

As illustrated in FIG. 19, the angled middle body portion 330 of each leg 302 and 304 may include a upper part 310 and a lower part 314 that are arranged such that they form an obtuse angle with each other. That is, the upper part 310 of the first leg 302 and the second leg 304 may extend away from each other, and the lower part 314 of the first leg 302 and the second leg 304 may extend towards each other.

The bottom portion 328 of the diamond wire form 100 may include the opposite second ends (318 and 320) of the first leg 302 and the second leg 304. Unlike the first ends (302*a*, 304*a*) of the first leg 302 and the second leg 304, the opposite second ends (318 and 320) of the first leg 302 and the second leg 304 may not be connected or joined. The second ends (318 and 320) of the first leg 302 and the second leg 304 may be hook or U-shaped. In particular, as illustrated in FIG. 19 the hook or U-shaped second ends (318 and 320) may be designed to face each other or the opening 322 while being curved upwards towards the curved top portion 326. That is, the tips 302*b* and 304*b* of the second ends 318 and 320, respectively, may face the top curved portion 326. Additionally, as illustrated in FIG. 19, the second ends (318 and 320) of the first leg 302 and the second leg 304 may be disposed or rest in the same plane as the remainder of the diamond wire form 110.

In particular, as illustrated in FIG. 17, the diamond wire form 110 may be coupled to the coupling bracket 106 by welding at least a portion of the hook or U-shaped second ends (318 and 320) of the first leg 302 and the second leg 304 to the second planar surface 204 to form a stiff connection. That is, in the example embodiment of FIG. 17, the diamond wire form 110 is attached to the coupling bracket 106 such that the diamond wire form 110 is not pivotable or rotatable with respect to the coupling bracket 106.

Figures 20A, 20B:
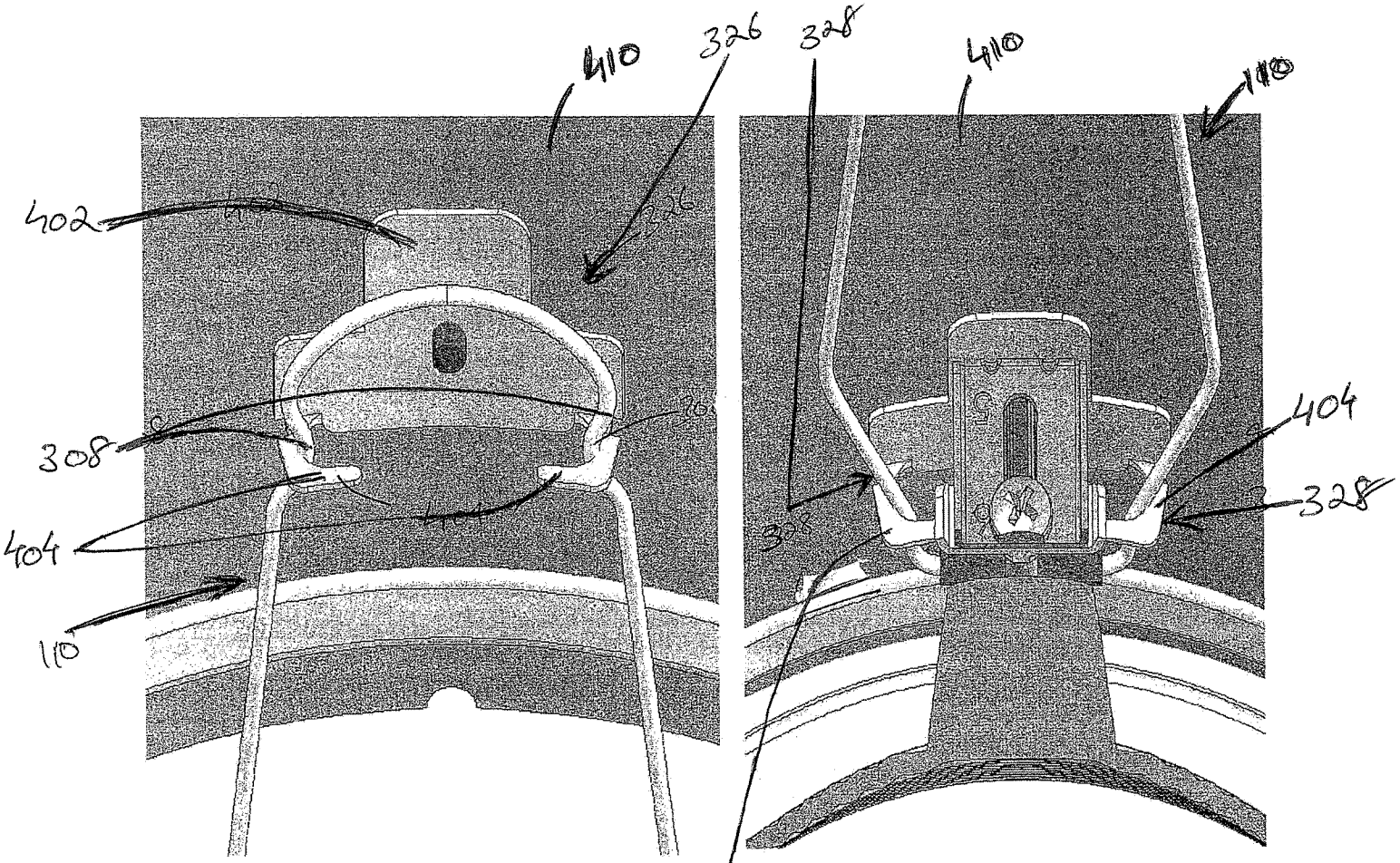
FIGS. 20A and 20B (collectively 'FIG. 20') illustrate how the finishing section is retained in a recessed housing can using the sixth example retention device of the finishing section and the receiver features of the recessed housing can, in accordance with example embodiments of the present disclosure.

As illustrated in FIGS. 20A and 20B, once the diamond wire form 110 is attached to the coupling bracket 106, the finishing section 100 may be mounted within the recessed housing can 410 using the pair of diamond wire forms 110. In particular, the recessed housing can 410 may include a pair of hook shaped wire form receivers 404 (herein 'receiver pair 404'). Initially, a user may insert the curved top surface 326 of a first diamond wire form 110 into a first receiver pair 404 till the first receiver pair 404 engages the bent-in portion 308 of the first diamond wire form 110. Once the first receiver pair 404 engages the bent-in portion 308 of the first diamond wire form 110, the first diamond wire form 110 may be in a pre-lock state (or partial lock as shown in FIG. 20A) where the finishing section 100 can hang from the first receiver pair 404 of the recessed housing can 410 via the first diamond wire form 110 without detaching from the recessed housing can 410.

With the finishing section 100 hanging from recessed housing can via the first diamond wire form, a user may insert the curved top surface 326 of a second diamond wire form 110 into a second receiver pair 404 of the recessed housing can 410 till the second receiver pair 404 engages the bent-in portion 308 of the second diamond wire form 110. Once the second receiver pair 404 engages the bent-in portion 308 of the second diamond wire form 110, the second diamond wire form 110 may also enter a pre-lock state (or partial lock). Once both the diamond wire forms 110 enter the pre-lock state, the finishing section 100 can temporarily hang from the first receiver pair 404 and the second receiver pair 404 of the recessed housing can 410 via the first diamond wire form 110 and the second diamond wire form 110 without detaching from the recessed housing can 410.

In certain example embodiments, a user may be provided an auditory or tactile feedback to inform the user that the finishing section has entered a pre-lock state. For example, the user may here a click sound or may feel the bent-in portion 308 of the diamond wire form 110 snap into the respective receiver pair 404. The pre-lock state allows the user to free his/her hands to make any additional adjustment or alignments before pushing the finishing section 100 further into the recessed housing can 410 to enter a full lock state. Further, the pre-lock state allows a user to adjust one diamond wire form while the other diamond wire form is partially locked into its respective receiver pair 404, thereby, providing installation flexibility to the user.

Once the first diamond wire form 110 and the second diamond wire form 110 of the finishing section 100 are in a pre-lock state, the finishing section 100 may be pushed further into the recessed housing can 410 to enter a full lock state (shown in FIG. 20B). Pushing the finishing section 100 further into the recessed housing can 410 causes the angled middle portion 330 (upper part 310) of each diamond wire form 110 to slide up along its respective receiver pair 404 till the respective receiver pair 404 passes a bent-out portion 324 of each diamond wire form 110 that is disposed between the upper part 310 and lower part 314 of the respective diamond wire form's angled middle portion 330. Once the receiver pairs 404 pass the bent-out portion 324 of the diamond wire forms 110, the receiver pairs 404 engage the lower part 314 of the diamond wire forms 110 that extend or are angled towards each other. Because the lower parts 314 are angled toward each other, the resistance is decreasing and the diamond wire forms 110 may slide along their respective receiver pairs 404 towards the bottom portion 328 of the diamond wire forms 110 with little or no pushing force, which in turn pulls the finishing section 100 further into the recessed housing can 410 till the top surface of the trim flange 120 engages the ceiling or the bottom edge of the recessed housing can 410.

Since the curved top portion 326 is first inserted into the receiver pair 404, hereinafter, the curved top portion 326 may be interchangeably referred to as the lead-in section. Further, the bent-in portion 308 may be interchangeably referred to as the pre-lock section. Similarly, the upper part 310 and the lower part 314 of both the legs (302, 304) may be interchangeably referred to as push up section and pull-up/locking section, respectively. In other words, the diamond wire form 110 includes a curved lead in-section 326. The ends of the lead-in section may be bent inward towards each other to form the pre-lock section 308 which then transitions into the push-in section 310 where the wire forms extend away from each other till the bent-out/transition point 324. Following the bent-out/transition point 324, the push-in section transitions into the pull-up/locking section 314 where the wire forms extend towards each other. Further, the pull-up/locking section 314 of the diamond wire form 110 transitions into a hook or U-shaped bottom portion 328 with ends that face each other and are curved upwards towards the lead-in section 326.

One of ordinary skill in the art can understand and appreciate that the diamond wire form 110 may be formed using flexible or spring material that allows the diamond wire form 110 to bend and flex as it passes through the receiver pair 404 in the recessed housing can 410. Further, even though FIG. 17 illustrates the diamond wire form 110 as being coupled to the coupling bracket 106 by welding the second ends 318 and 320 of the first leg 302 and the second leg 304 to the second planar surface 204 of the coupling bracket 106, one of ordinary skill in the art can understand and appreciate that in other example embodiments, the diamond wire form may be attached to the coupling bracket using any other appropriate coupling methods without departing from a broader scope of the present disclosure. For example, FIGS. 21, 23, 25, and 27 illustrate other forms of coupling the diamond wire form to the coupling bracket. Further, as illustrated in FIGS. 22, 24, 26, and 28, depending on the type of coupling, the shape, size, and/or structure of the coupling bracket and the diamond wire form may vary from that of FIGS. 17-20.

FIGS. 21-28 will now be described in association with alternate types of coupling between the diamond wire form and the coupling bracket. At the outset, it is noted that the finishing section, the coupling bracket, and the diamond wire forms of FIGS. 21-28 are substantially similar to that in FIGS. 17-20, except for the second planar portion of the coupling bracket, the bottom portion (second ends) of the diamond wire form, and the type of coupling. Accordingly, for sake of brevity and to avoid repetition, the following description of FIGS. 21-28 includes only differences between FIGS. 21-28 and FIGS. 17-20, namely, the second planar portion of the coupling bracket, the bottom portion (second ends) of the diamond wire form, and the type of coupling.

Figure 21:
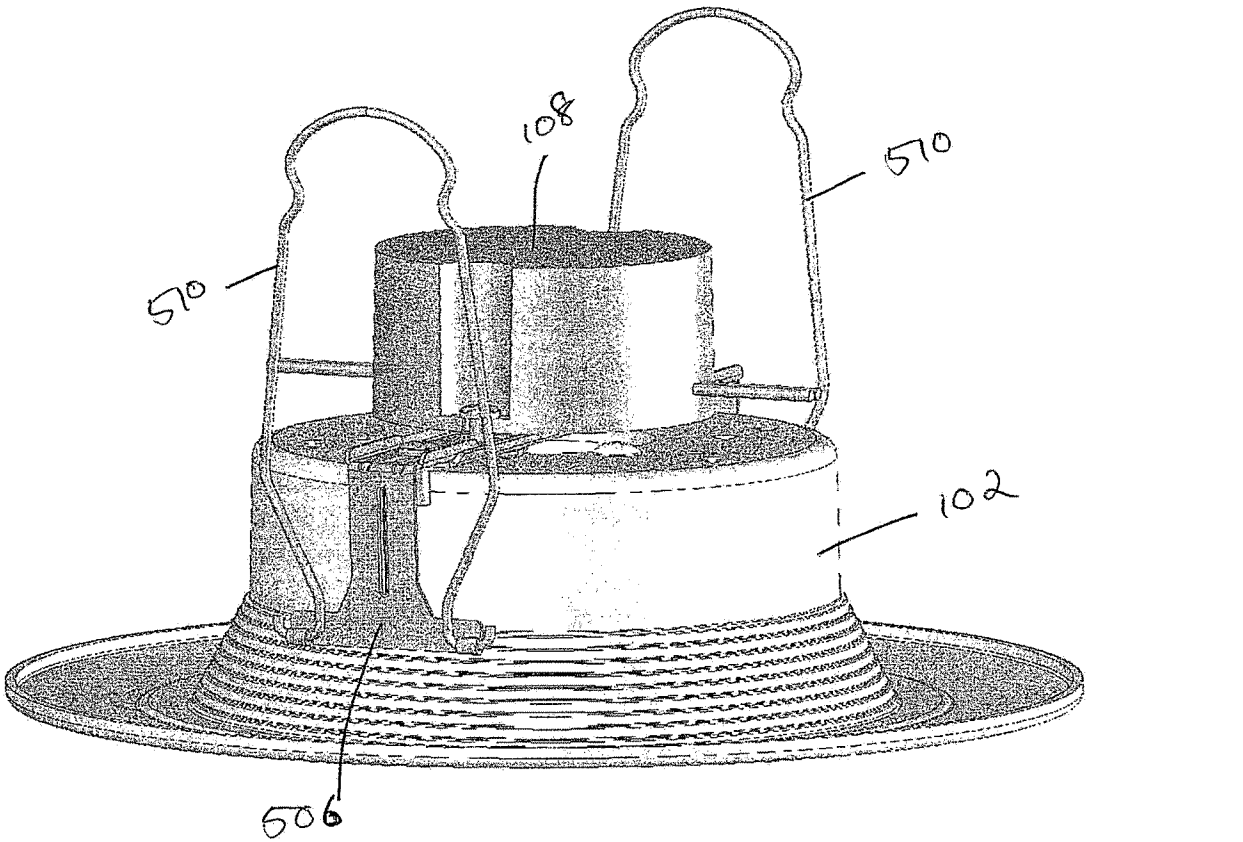
FIG. 21 illustrates a perspective view of a finishing section with a seventh example retention device, in accordance with example embodiments of the present disclosure.
Figure 22B:
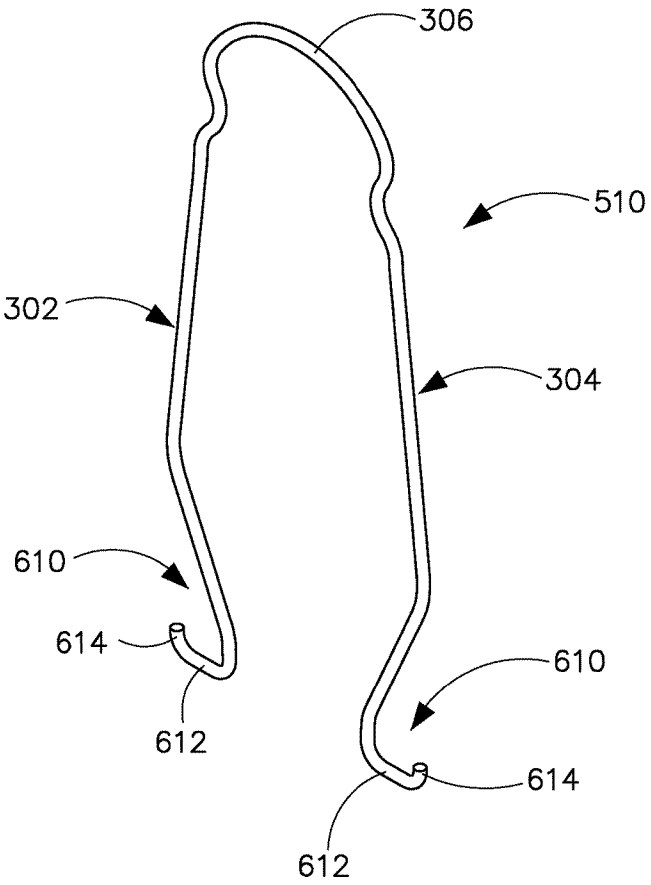
FIGS. 22A and 22B (collectively 'FIG. 22') illustrate perspective views of the seventh example retention device and its corresponding coupling bracket for coupling to the finishing section, in accordance with example embodiments of the present disclosure.
Figure 22A:
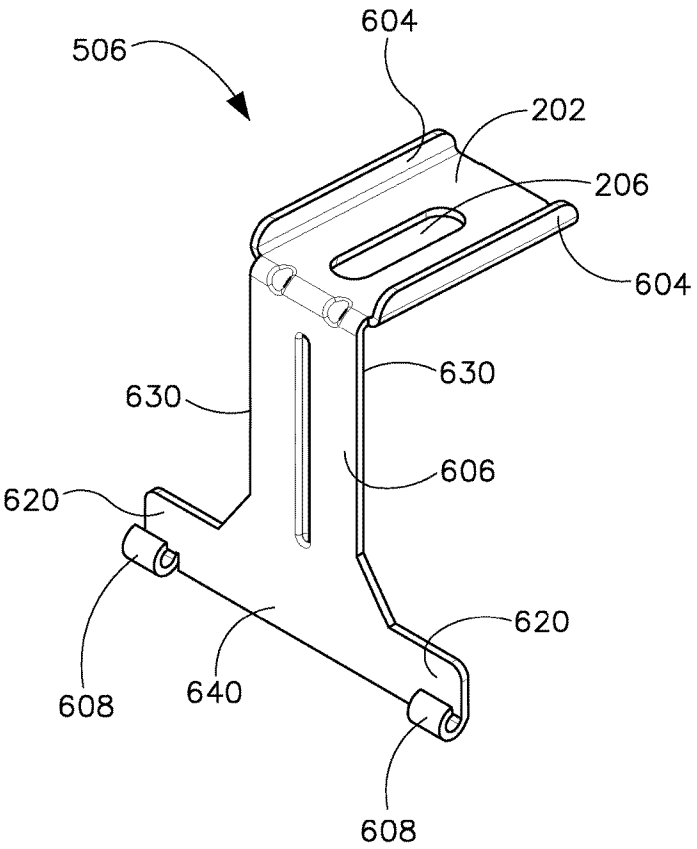

Turning to FIGS. 21 and 22, FIG. 21 illustrates a perspective view of a finishing section with a seventh example retention device, in accordance with example embodiments of the present disclosure; and FIGS. 22A and 22B (collectively 'FIG. 22') illustrate perspective views of the seventh example retention device and its corresponding coupling bracket for coupling to the finishing section, in accordance with example embodiments of the present disclosure.

The diamond wire form 510 of FIGS. 21 and 22 may be different from the diamond wire form 110 of FIGS. 17-20 in that the hook or U-shaped second ends 612 of the first leg 302 and the second leg 304 may be configured to face away from each other and/or the opening 322 in opposite directions while being curved upwards. That is, the tips 614 of the second ends 612 may face upward.

Further, unlike the second planar surface 204 of the coupling bracket 106, the second planar surface 604 of the coupling bracket 506 in FIGS. 21 and 22 may include flanges 620 that extend out in opposite directions from a bottom portion of the second planar surface's longitudinal edges 630. Furthermore, each flange 620 may include a receiving cup 608 or hinge disposed at opposite ends of the second planar surface's bottom edge 640. As illustrated in FIG. 21, the receiving cups 608 may be configured to pivotally or hingedly couple the diamond wire form 510 to the coupling bracket 506 by receiving and securely retaining the second ends 612 of the first and second leg (302, 304) of the diamond wire form 510. In particular, the second ends 612 of the first and second leg (302, 304) may be received and secured within the receiving cups 608 such that the tip 614 of each second end 612 extends out from the respective receiving cup 608, as illustrated in FIG. 21. Even though FIG. 21 does not illustrate the diamond wire form 510 in a pivoted state, one of ordinary skill in the art can understand and appreciate that the diamond wire form 510 may pivot about the receiving cups 608 from a first state shown in FIG. 21 to a pivoted state where the diamond wire form 510 radially extends out from the finishing cone 102.

Figure 23:
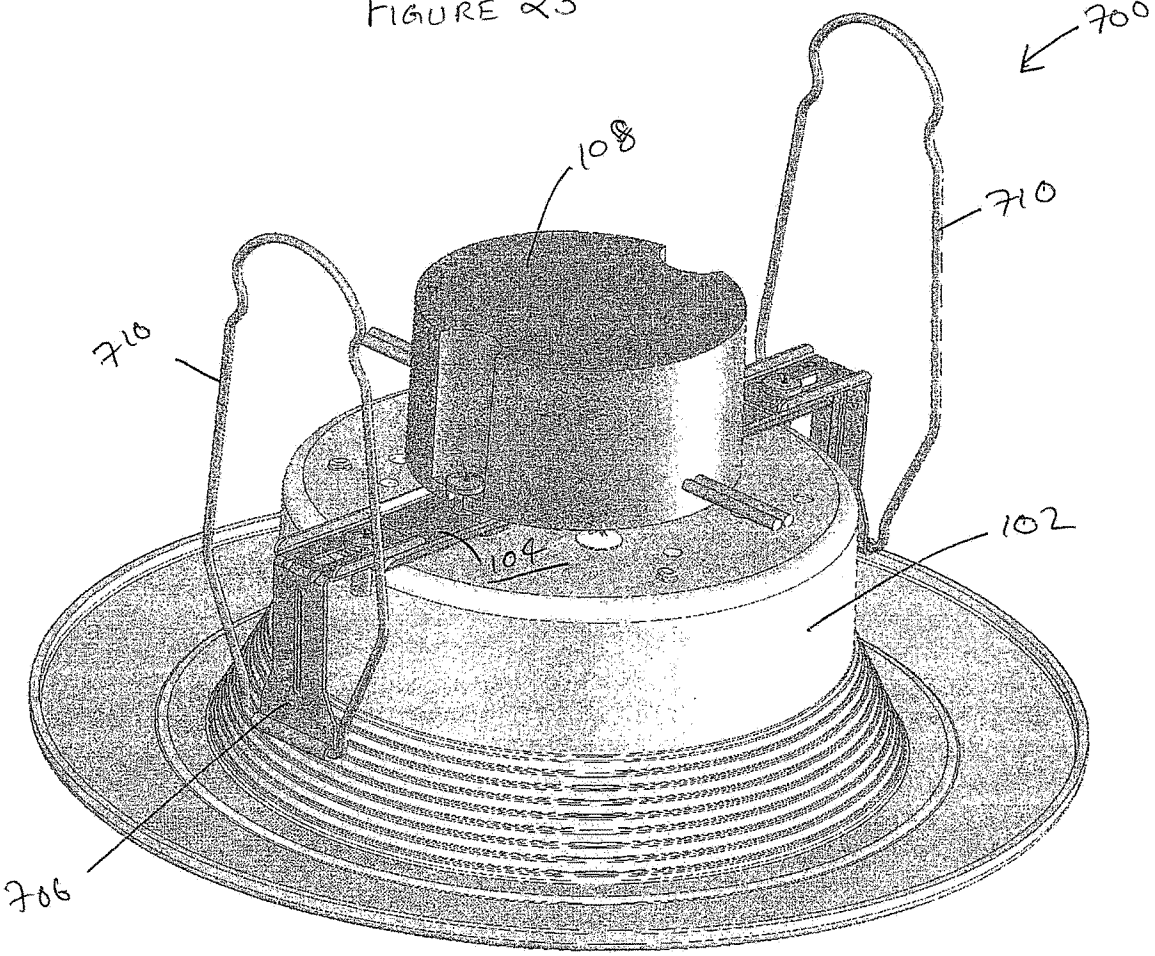
FIG. 23 illustrates a perspective view of a finishing section with a eighth example retention device, in accordance with example embodiments of the present disclosure.
Figure 24B:
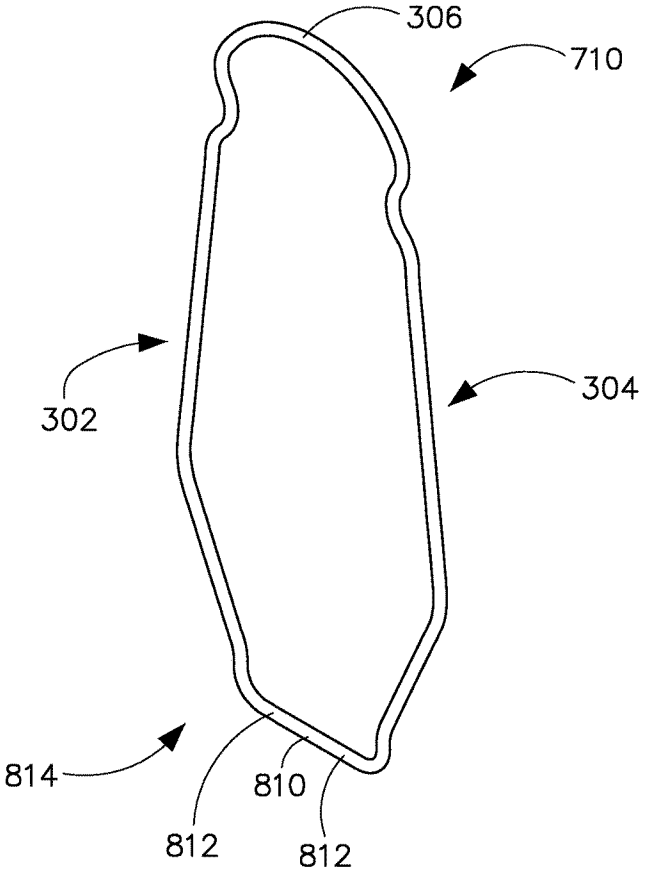
FIGS. 24A and 24B (collectively 'FIG. 24') illustrate perspective views of the eighth example retention device and its corresponding coupling bracket for coupling to the finishing section, in accordance with example embodiments of the present disclosure.
Figure 24A:
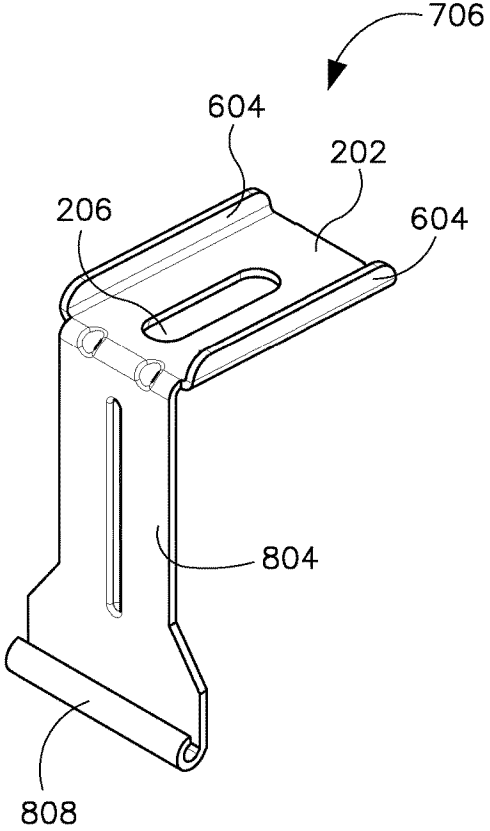

Turning to FIGS. 23 and 24, FIG. 23 illustrates a perspective view of a finishing section with an eighth example retention device, in accordance with example embodiments of the present disclosure; and FIGS. 24A and 24B (collectively 'FIG. 24') illustrate perspective views of the eighth example retention device and its corresponding coupling bracket for coupling to the finishing section, in accordance with example embodiments of the present disclosure.

The diamond wire form 710 of FIGS. 23 and 24 may be different from the diamond wire form 110 of FIGS. 17-20 in that the second ends 812 of the first leg 302 and the second leg 304 may be joined at a joint 810 disposed at the bottom portion 814 of the diamond wire form 710. Further, the coupling bracket 706 may include a receiving cup 808 or hinge disposed at a bottom edge of the second planar surface 804. The receiving cup 808 may extend the entire length of the bottom edge and may be configured to pivotally or hingedly couple the diamond wire form 710 to the coupling bracket 706 by receiving and securely retaining the second ends 612 of the first and second leg (302, 304) that are joined at the joint 810, as illustrated in FIG. 23.

Figure 27:
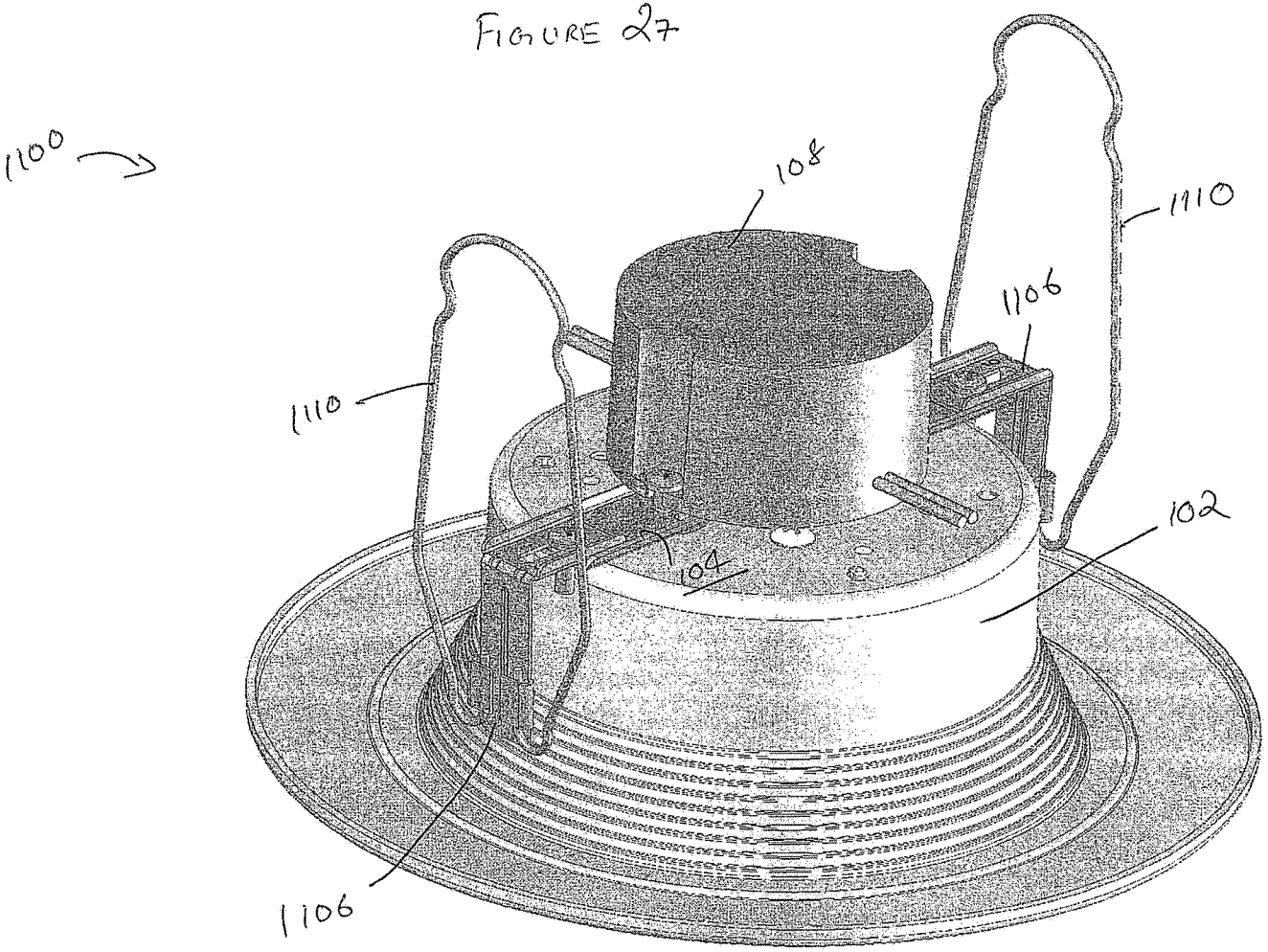
FIG. 27 illustrates a perspective view of a finishing section with a tenth example retention device, in accordance with example embodiments of the present disclosure.
Figure 28B:
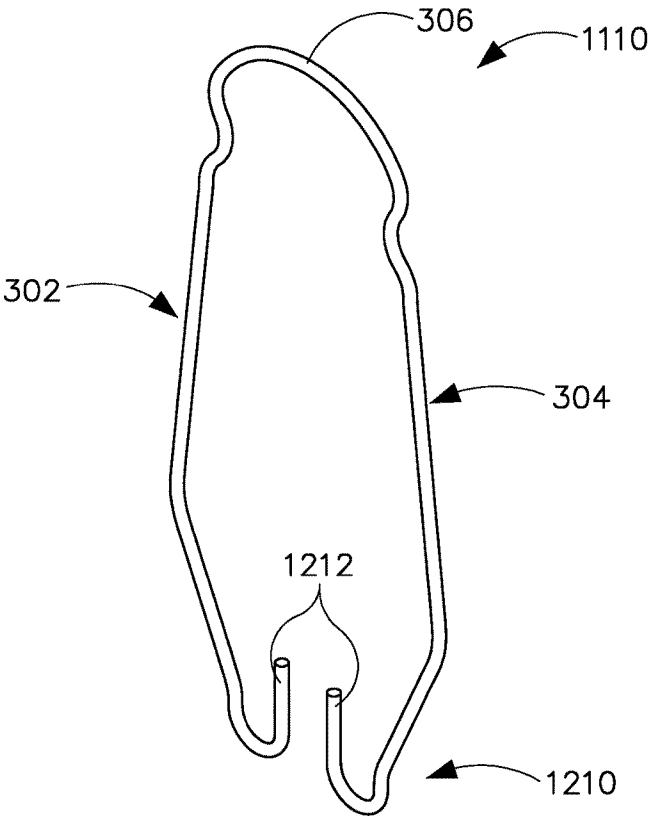
FIGS. 28A and 28B (collectively 'FIG. 28') illustrate perspective views of the tenth example retention device and its corresponding coupling bracket for coupling to the finishing section, in accordance with example embodiments of the present disclosure.
Figure 28A:
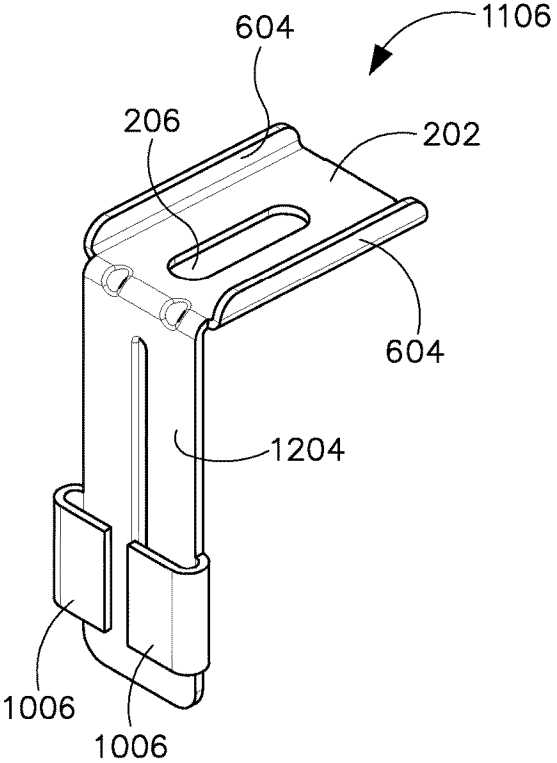

Turning to FIGS. 27 and 28, FIG. 27 illustrates a perspective view of a finishing section with a tenth example retention device, in accordance with example embodiments of the present disclosure; and FIGS. 28A and 28B (collectively 'FIG. 28') illustrate perspective views of the tenth example retention device and its corresponding coupling bracket for coupling to the finishing section, in accordance with example embodiments of the present disclosure.

The diamond wire form 1110 of FIGS. 27 and 28 may be different from the diamond wire form 110 of FIGS. 17-20 in that the second ends 1212 of the first leg 302 and the second leg 304 of the diamond wire form 1110 may be longer and may further extend upwards towards the top curved portion 326 than the second ends 318 and 320 of diamond wire form 110. Further, the coupling bracket 1106 may include a pair of clamps 1006 disposed on the second planar surface 1204 of the coupling bracket 1106. Each clamp 1006 may extend from a longitudinal edge of the second planar surface 1204 towards an opposite longitudinal edge of the second planar surface 1204. As illustrated in FIG. 27, the clamps 1006 may be configured to attach the diamond wire form 1110 to the coupling bracket 1106 by receiving and securing the second ends 1212 of the diamond wire form 1110 within the clamps 1006.

Figure 25:
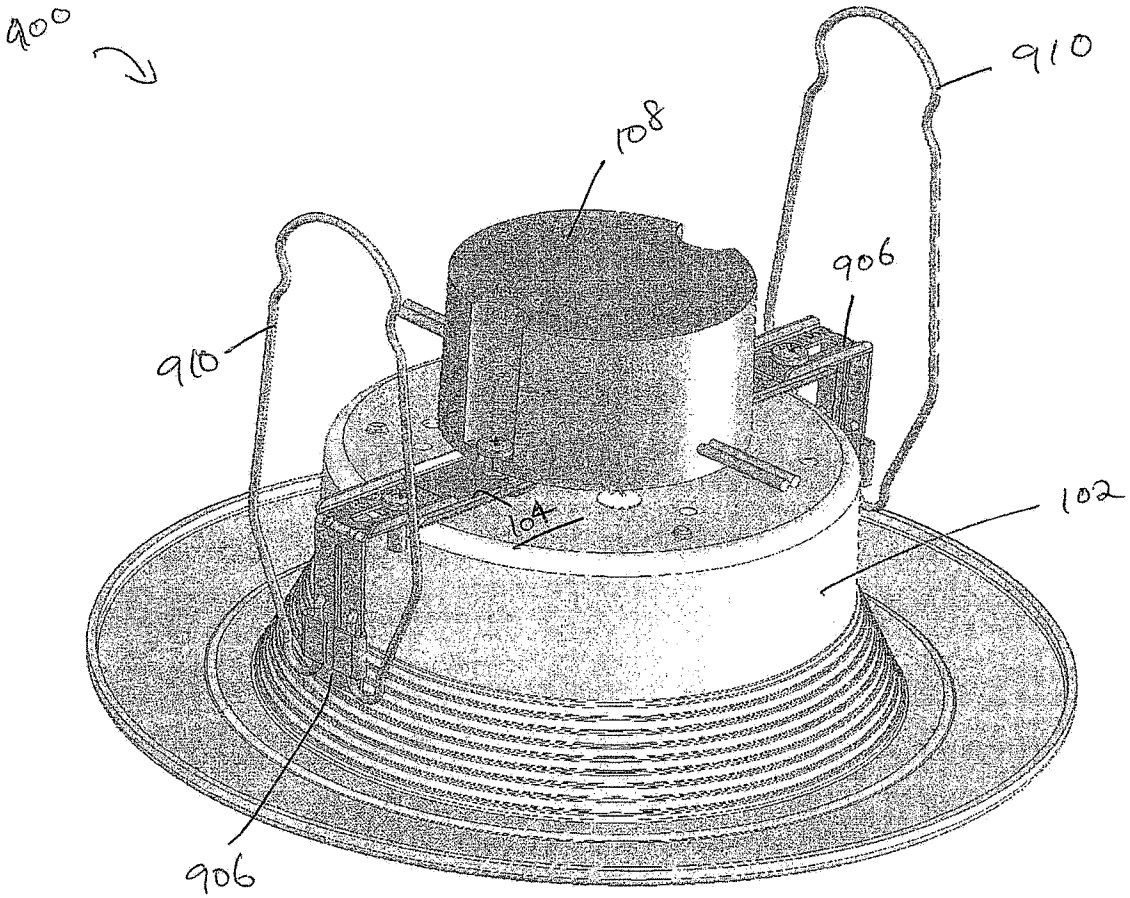
FIG. 25 illustrates a perspective view of a finishing section with a ninth example retention device, in accordance with example embodiments of the present disclosure.
Figure 26B:
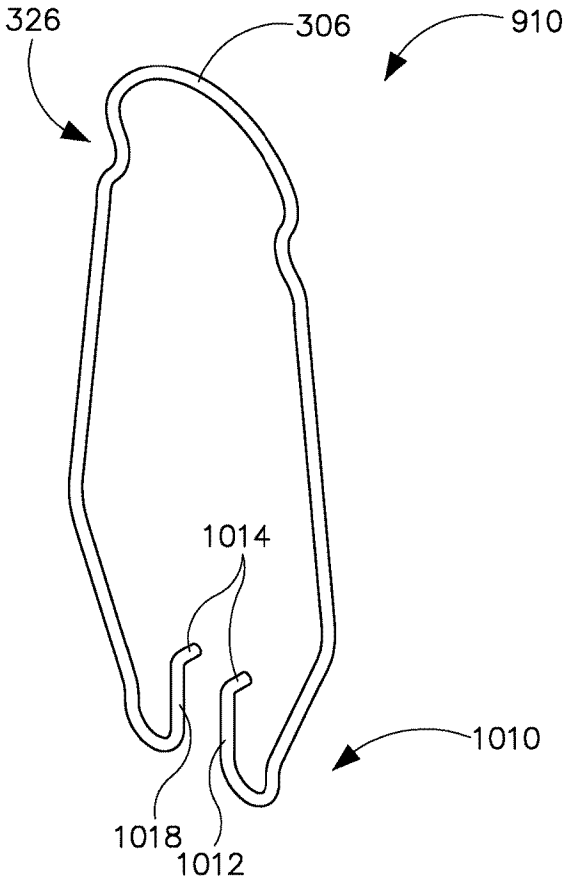
FIGS. 26A and 26B (collectively 'FIG. 26') illustrate perspective views of the ninth example retention device and its corresponding coupling bracket for coupling to the finishing section, in accordance with example embodiments of the present disclosure.
Figure 26A:
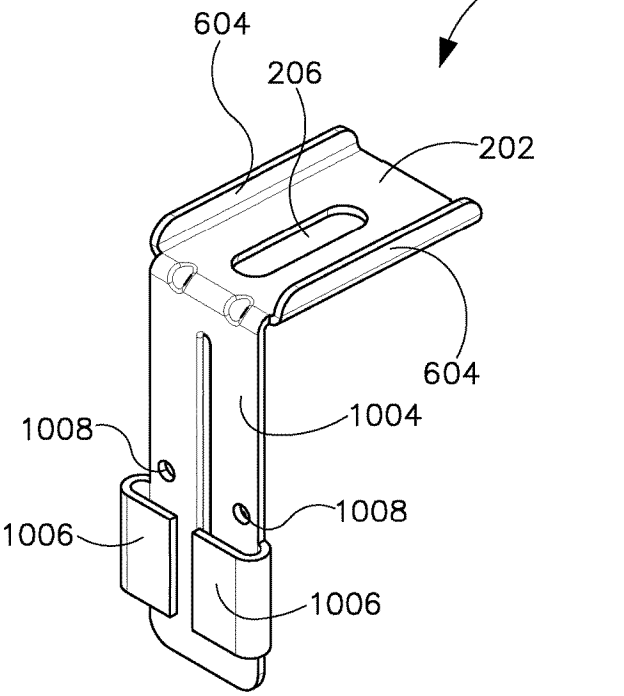

Turning to FIGS. 25 and 26, FIG. 25 illustrates a perspective view of a finishing section with a ninth example retention device, in accordance with example embodiments of the present disclosure; and FIGS. 26A and 26B (collectively 'FIG. 26') illustrate perspective views of the ninth example retention device and its corresponding coupling bracket for coupling to the finishing section, in accordance with example embodiments of the present disclosure.

The diamond wire form 910 of FIGS. 25 and 26 may be substantially similar to the diamond wire form 1110 of FIGS. 27 and 28 except for the tip of the second ends of the diamond wire forms. In FIGS. 25 and 26, the tips 1014 of the second ends 1012 of the diamond wire form 910 may be bent such that it is substantially perpendicular to a plane in which a remainder of the diamond wire form 910 rests. Further, the coupling bracket 906 includes a pair of locating holes (through apertures) 1008 that are disposed on the second planar surface 1004 above the clamps 1006. The second ends 1012 of the diamond wire form 910 may be secured by the clamps 1006 as discussed above in association with FIGS. 27 and 28. Additionally, the tips 1014 of the diamond wire form's second ends 1012 may pass through the locating holes 1008 to further secure the diamond wire form 910 to the coupling bracket 906.

One of ordinary skill in the art can understand and appreciate that the different diamond wire form variations, coupling bracket variations, and still or hinged coupling methods shown in FIGS. 17-28 are not limiting. That is, any other appropriate variation in the coupling method and/or design of the diamond wire form and coupling bracket is within the broader scope of the present disclosure.

Friction Retention Devices

An example friction retention device will be described in the following paragraphs in association with FIG. 16. In particular, FIG. 16 illustrates a perspective view of a friction retention device of a recessed luminaire and a friction retention device receiver of the recessed housing can, in accordance with example embodiments of the present disclosure.

Referring to FIG. 16, the friction retention device 2800 includes a light fixture section 2802 that is configured to be coupled to a finishing cone of a recessed or surface mount luminaire. The light fixture section 2802 may include a bottom curved edge 2806, a top curved edge 2804 disposed opposite the bottom curved edge 2806, a curved intermediate edge 2805, a first lateral edge 2807 disposed between one end of the bottom curved edge 2806 and a corresponding end of the top curved edge 2804, a second lateral edge 2807 disposed between an opposite end of the bottom curved edge 2806 and a corresponding opposite end of the top curved edge 2804, and a body 2808 disposed between the bottom and top curved edges (2804, 2806) and the two lateral edges 2807. In particular, the bottom curved edge 2806 may be longer than the top curved edge 2804. Accordingly, the light fixture section 2802 may taper from the bottom curved edge 2806 towards the top curved edge 2804. Further, the body 2808 of the light fixture section 2802 may include a through aperture 2810 that is disposed adjacent the bottom curved edge 2806 for coupling the light fixture section 2802 to a finishing cone of a recessed or surface mount luminaire. In particular, the light fixture section 2802 may be formed using spring steel or other suitable flexible material.

In addition to the light fixture section 2802, the friction retention device 2800 may include a recessed can section 2850 that is configured to be coupled to an inner surface of a recessed housing can 410. In particular, the recessed can section 2850 may include a mounting portion 2852 that comprises a first planar section 2860 and a through aperture 2858 therein to couple the recessed can section 2850 to the recessed housing can 410. Further, the recessed can section 2850 may include a light fixture coupling section 2854 that includes a second planar surface 2862 that is substantially perpendicular to the first planar portion 2860. The second planar surface 2862 may include an elongated linear slot 2856 that is configured to receive and capture the substantially curved light fixture section 2802 of the friction retention device 2800 by interference fit (friction fit) to couple a recessed or surface mount luminaire to the recessed housing can 410. In particular, the top curved edge 2804 of the light fixture section 2802 may be inserted through the elongated linear slot 2856 of the recessed can section 2850 and pushed in which in turn flattens the light fixture section 2802 and creates a friction or interference to retain the recessed or surface mount luminaire within the recessed housing can 410.

Although the present disclosure is described with reference to example embodiments, it should be appreciated by those skilled in the art that various modifications are well within the scope of the present disclosure. From the foregoing, it will be appreciated that an embodiment of the present disclosure overcomes the limitations of the prior art. Those skilled in the art will appreciate that the present disclosure is not limited to any specifically discussed application and that the embodiments described herein are illustrative and not restrictive. From the description of the example embodiments, equivalents of the elements shown therein will suggest themselves to those skilled in the art, and ways of constructing other embodiments of the present disclosure will suggest themselves to practitioners of the art. Therefore, the scope of the present disclosure is not limited herein.

What is claimed is:

1. A luminaire comprising:
a finishing section that comprises:
a finishing cone that defines an internal cavity;
a light source disposed within the internal cavity of the finishing cone; and
one or more retention devices that are coupled to the finishing cone and configured to mount the finishing cone within a recessed can having one or more retention device receivers, each of the one or more retention devices comprising:
a curved middle portion,
a first leg that extends out from one end of the curved middle portion,
a second leg that extends out from an opposite end of the curved middle portion in a direction substantially opposite to that of the first leg, and
a hook shaped feature disposed at ends of each of the first leg and the second leg that are farthest away from each other,
wherein the one or more retention devices are coupled to the finishing cone via a mounting bracket that is coupled to the finishing cone, and
wherein the one or more retention devices are removably coupled to the mounting bracket.

2. The luminaire of claim 1, wherein the curved middle portion of each of the one or more retention devices has a substantially C-shaped profile, and wherein the curved middle portion defines a through opening that is configured to receive a fastener therethrough to couple each of the one or more retention devices to the finishing cone.

3. The luminaire of claim 1, wherein the curved middle portion of each of the one or more retention devices has a substantially U-shaped profile, and wherein the curved middle portion is coupled to a mounting bracket using a snap fit mechanism.

4. The luminaire of claim 1, wherein the hook shaped feature disposed at the ends of each of the first leg and the second leg is configured to engage the one or more retention device receivers in the recessed can to mount the finishing cone within the recessed can.

5. The luminaire of claim 1, wherein the one or more retention devices comprises a spring wire form.

6. The luminaire of claim 1, wherein an open end of the hook shaped feature disposed at the ends of each of the first leg and the second leg and an open end of the curved middle portion face a first direction.

7. A luminaire comprising:
a finishing section that comprises:
a finishing cone that defines an internal cavity;
a light source disposed within the internal cavity of the finishing cone; and
one or more retention devices that are coupled to the finishing cone and configured to mount the finishing cone within a recessed can having one or more retention device receivers, each of the one or more retention devices comprising:
a curved middle portion,
a first leg that extends out from one end of the curved middle portion,
a second leg that extends out from an opposite end of the curved middle portion in a direction substantially opposite to that of the first leg, and
a hook shaped feature disposed at ends of each of the first leg and the second leg that are farthest away from each other,
wherein an open end of the curved middle portion faces a first direction and an open end of the hook shaped feature disposed at the ends of each of the first leg and the second leg face a second direction that is opposite to the first direction.

8. The luminaire of claim 7, wherein the one or more retention devices are welded to a mounting bracket that is coupled to the finishing cone.

9. A luminaire comprising:
a finishing section that comprises:
a finishing cone that defines an internal cavity;
a light source disposed within the internal cavity of the finishing cone; and one or more retention devices that are coupled to the finishing cone and configured to mount the finishing cone within a recessed can having one or more retention device receivers, each of the one or more retention devices comprising:

a first leg, wherein the first leg has a first hook shaped feature disposed at a first end of the first leg, and wherein a second opposite end of the first leg is bent such that it projects substantially perpendicular to the first leg, and a second leg that is separate from the first leg, wherein the second leg has a second hook shaped feature disposed at a first end of the second leg, and wherein a second opposite end of the second leg is bent such that it projects substantially perpendicular to the second leg, wherein the one or more retention devices are coupled to the finishing cone via a mounting bracket that is coupled to the finishing cone, and wherein the second opposite ends of the first leg and the second leg are snapped into respective clamps formed in the mounting bracket to couple the first leg and the second leg to the mounting bracket.

10. The luminaire of claim 9, wherein an open end of the first hook shaped feature and the second hooked shaped feature face a first direction, and the second opposite ends of the first leg and the second leg extend in the first direction.

11. The luminaire of claim 9, wherein an open end of the first hook shaped feature and the second hooked shaped feature face a first direction, and the second opposite ends of the first leg and the second leg extend in an opposite second direction.

12. The luminaire of claim 9, wherein the first hook shaped feature and the second hook shaped feature are configured to engage the one or more retention device receivers in the recessed can to mount the finishing cone within the recessed can.

13. A retention device comprising:

a curved top section that has a substantially C-shaped profile, a first leg extending from a first end of the curved top section, a second leg extending from a second end of the curved top section, wherein each of the first leg and the second leg includes:

a first vertical portion extending from a respective end of the curved top section, a second bent portion extending from the first vertical portion at an obtuse angle to the first vertical portion, a third bent portion extending from the second bent portion at an acute angle to the second bent portion, and a hook shaped feature extending from third bent portion.

14. The retention device of claim 13:

wherein the first vertical portion of the first leg and the second leg extends from the opposite ends of the curved top section in a first direction such that they are substantially parallel and adjacent to each other, wherein the second bent portion of the first leg and the second leg extends away from each other, and wherein the third bent portion of the first leg extends in a second direction towards the second leg and the third bent portion of the second leg extends in a third direction towards the first leg such that the third bent portion of the first leg and the second leg cross each other.

15. The retention device of claim 13, wherein the curved top section defines a coupling through aperture that is configured to receive a fastener therethrough to couple the retention device to a finishing cone.

16. The retention device of claim 13, wherein the retention device is coupled to a mounting bracket that is removably attached to the finishing cone, and wherein the retention device is a spring wire form.

* * * * *